US011926355B2

(12) United States Patent
Soule et al.

(10) Patent No.: US 11,926,355 B2
(45) **Date of Patent: *Mar. 12, 2024**

(54) SYSTEM AND/OR METHOD FOR PLATOONING

(71) Applicant: Parallel Systems, Inc., Los Angeles, CA (US)

(72) Inventors: Matthew Soule, Los Angeles, CA (US); John Howard, Los Angeles, CA (US); Benjamin Stuart Stabler, Los Angeles, CA (US)

(73) Assignee: Parallel Systems, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/077,384

(22) Filed: Dec. 8, 2022

(65) Prior Publication Data

US 2023/0099782 A1 Mar. 30, 2023

Related U.S. Application Data

(63) Continuation of application No. 17/732,143, filed on Apr. 28, 2022, now Pat. No. 11,548,542.

(60) Provisional application No. 63/180,867, filed on Apr. 28, 2021, provisional application No. 63/195,617, filed on Jun. 1, 2021, provisional application No. 63/299,786, filed on Jan. 14, 2022.

(51) Int. Cl.
*B61L 27/10* (2022.01)
*B61L 27/70* (2022.01)

(52) U.S. Cl.
CPC ..... *B61L 27/10* (2022.01); *B61L 27/70* (2022.01)

(58) Field of Classification Search
CPC ..... B61L 27/10; B61L 27/70; B61L 27/20; B61L 23/34; B61L 21/10
See application file for complete search history.

(56) References Cited

U.S. PATENT DOCUMENTS

| | | | |
|---|---|---|---|
| 3,848,533 | A | 11/1974 | Grow |
| 4,245,561 | A | 1/1981 | Krug |
| 10,723,370 | B1 | 7/2020 | Heaton |
| 2004/0089188 | A1 | 5/2004 | Lechner et al. |
| 2007/0107620 | A1 | 5/2007 | Wagner |
| 2012/0265378 | A1 | 10/2012 | Peitzke et al. |
| 2013/0019774 | A1 | 1/2013 | Ahuja et al. |
| 2013/0196519 | A1 | 8/2013 | Krause et al. |

(Continued)

FOREIGN PATENT DOCUMENTS

| | | | |
|---|---|---|---|
| DE | 19518289 | A1 | 11/1996 |
| EP | 3756972 | A1 | 12/2020 |

(Continued)

OTHER PUBLICATIONS

"Bogie designs, Extract from the Railway technical handbook, vol. 1, chapter 2, p. 24 to 41,", https://www.skf.com/binaries/pub12/Images/0901d1968019f48b-RTB-1-02-Bogie-designs_tcm_12-62732.pdf, Pub 42/P2 12782 EN—2012.

(Continued)

*Primary Examiner* — Russell Frejd
(74) *Attorney, Agent, or Firm* — Jeffrey Schox; Diana Lin

(57) ABSTRACT

The system can include a dispatcher and a plurality of cars. However, the system 100 can additionally or alternatively include any other suitable set of components. The system 100 functions to enable platooning of the plurality of cars (e.g., by way of the method S100).

20 Claims, 12 Drawing Sheets

(56) References Cited

U.S. PATENT DOCUMENTS

| | | | |
|---|---|---|---|
| 2013/0333590 | A1 | 12/2013 | Rodet |
| 2015/0191186 | A1 | 7/2015 | Lucisano |
| 2015/0225003 | A1 | 8/2015 | Morton |
| 2016/0137212 | A1 | 5/2016 | James et al. |
| 2016/0167681 | A1 | 6/2016 | Rodet |
| 2017/0291618 | A1 | 10/2017 | Karner et al. |
| 2018/0079436 | A1 | 3/2018 | Fifield |
| 2018/0322791 | A1 | 11/2018 | Brooks et al. |
| 2019/0054929 | A1 | 2/2019 | Yao et al. |
| 2020/0130659 | A1 | 4/2020 | Grasso et al. |
| 2021/0070335 | A1 | 3/2021 | Bjurström |
| 2021/0188332 | A1 | 6/2021 | Brooks et al. |

FOREIGN PATENT DOCUMENTS

| | | | |
|---|---|---|---|
| KR | 20160126137 | A | 11/2016 |
| WO | 2019165147 | A1 | 8/2019 |
| WO | 2020208438 | A1 | 10/2020 |
| WO | 2022006620 | A1 | 1/2022 |

OTHER PUBLICATIONS

"Magazine for intermodal exchange and development", Intermodal & Containers Box, 2016, 22.

"Shift2rail by rAGV What we do", The Wayback Machine—https://web.archive.org/web/20210728131045/http://ragv.nl/wat-wij-doen/, downloaded Nov. 30, 2022.

Aguila, Mark , "SpoorParade Bersco Raptor Digital Rail-AGV lab Part 1", https://www.youtube.com/watch?v=4rV3Xvd0Ft8, 2014, downloaded Nov. 30, 2022.

Aguila, Mark , "SpoorParade Bersco Raptor Digital Rail-AGV lab Part 2", https://www.youtube.com/watch?v=dEi9WnH6HK8, 2014, downloaded Nov. 30, 2022.

Aguila, Mark , "SpoorParade Bersco Raptor Digital Rail-AGV lab Part 3", https://www.youtube.com/watch?v=IMBVT9orxiQ, 2014, downloaded Nov. 30, 2022.

Aguila, Mark , "SpoorParade Bersco Raptor Digital Rail-AGV lab Part 4", https://www.youtube.com/watch?v=xgbu-r5w5TY, 2014, downloaded Nov. 30, 2022.

Aguila, Mark , "SpoorParade Bersco Raptor Digital Rail-AGV lab Part 5", https://www.youtube.com/watch?v=yGRbDL9sv2Q, 2014, downloaded Nov. 30, 2022.

Aguila, Mark , "SpoorParade Bersco Raptor Digital Rail-AGV lab Part 6", https://www.youtube.com/watch?v=7P6xPOW2CM8, 2014, downloaded Nov. 30, 2022.

Aguila, Mark , "SpoorParade Bersco Raptor Digital Rail-AGV lab Part 7", https://www.youtube.com/watch?v=Bkc2LovxZHs, 2014, downloaded Nov. 30, 2022.

Huizing, John , "The rAGV concept by TSone—explained", https://www.youtube.com/watch?v=ge276va9Myw, 2015, downloaded Nov. 30, 2022.

Quaglietta, E., "Analysis of Platooning Train Operations underV2V Communication-Based Signaling: Fundamental Modeling u and Capacity Impacts of Virtual Coupling", Delft University of Technology, Proceedings of the 98th Transportation Research Board Annual Meeting, pp. 1-17. (Year: 2019).

Wu, Xingwen , et al., "Analysis of steering performance of differential coupling wheelset", Journal of Modern Transportation, vol. 22, pp. 65-75 (2014).

SYSTEM AND/OR METHOD FOR PLATOONING

CROSS REFERENCE TO RELATED APPLICATIONS

This application is a continuation of U.S. Application Ser. No. 17/732,143, filed 28 Apr. 2022, now issued as U.S. Pat. No. 11, 548, 542, which claims the benefit of U.S. Provisional Application No. 63/180,867, filed 28 Apr. 2021, U.S. Provisional Application No. 63/195,617, filed 1 Jun. 2021, and U.S. Provisional Application No. 63/299,786, filed 14 Jan. 2022, and each of which is incorporated herein in its entirety by this reference.

This application incorporates by reference U.S. application Ser. No. 17/335,732, filed 1 Jun. 2021, which claims the benefit of U.S. Provisional Application No. 63/032,196, filed 29 May 2020, each of which is incorporated herein in its entirety by this reference.

TECHNICAL FIELD

This invention relates generally to the transportation field, and more specifically to a new and useful vehicle platooning system and/or method in the transportation field.

DESCRIPTION OF THE PREFERRED EMBODIMENTS

The following description of the preferred embodiments of the invention is not intended to limit the invention to these preferred embodiments, but rather to enable any person skilled in the art to make and use this invention.

1. Overview

Figure 1A:
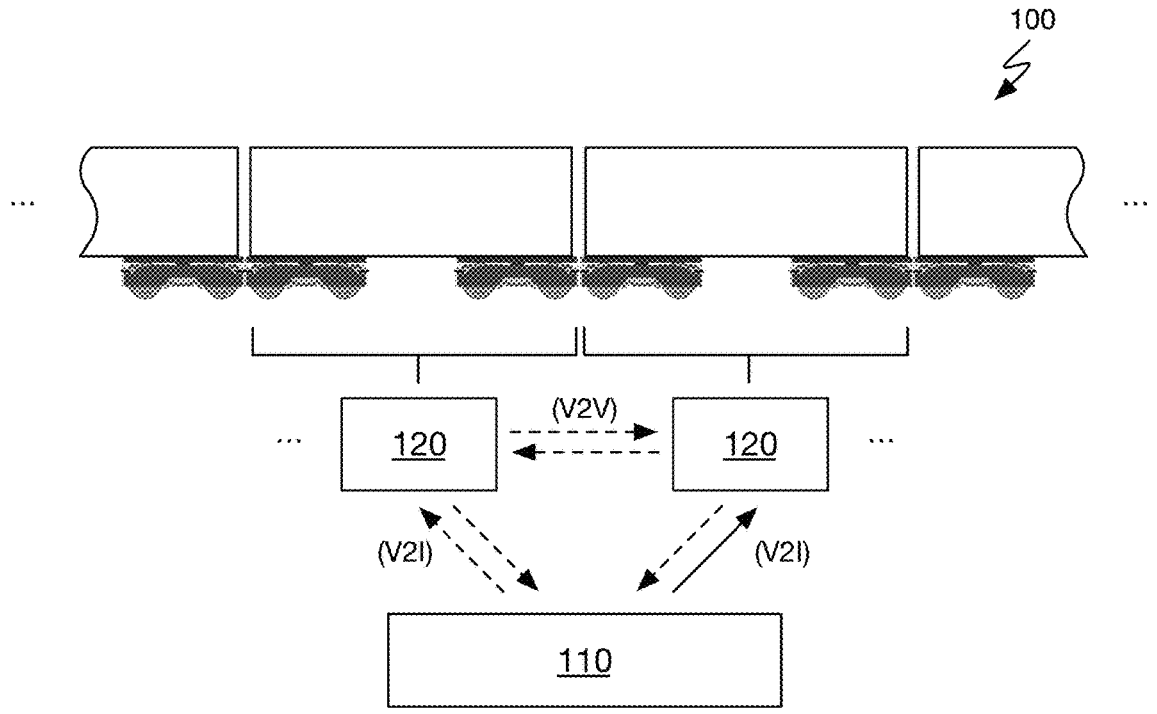
FIG. 1A-B is a schematic representation of a variant of the system.

The system 100, an example of which is shown in FIG. 1A, can include a dispatcher and a plurality of cars. However, the system 100 can additionally or alternatively include any other suitable set of components. The system 100 functions to enable platooning of the plurality of cars (e.g., by way of the method S100).

In a first set of variants, the cars referenced in conjunction with the system and/or method can be the electric vehicle(s) as described in U.S. application Ser. No. 17/694,499, filed 14 Mar. 2022, which is incorporated herein in its entirety by this reference.

Figure 5:
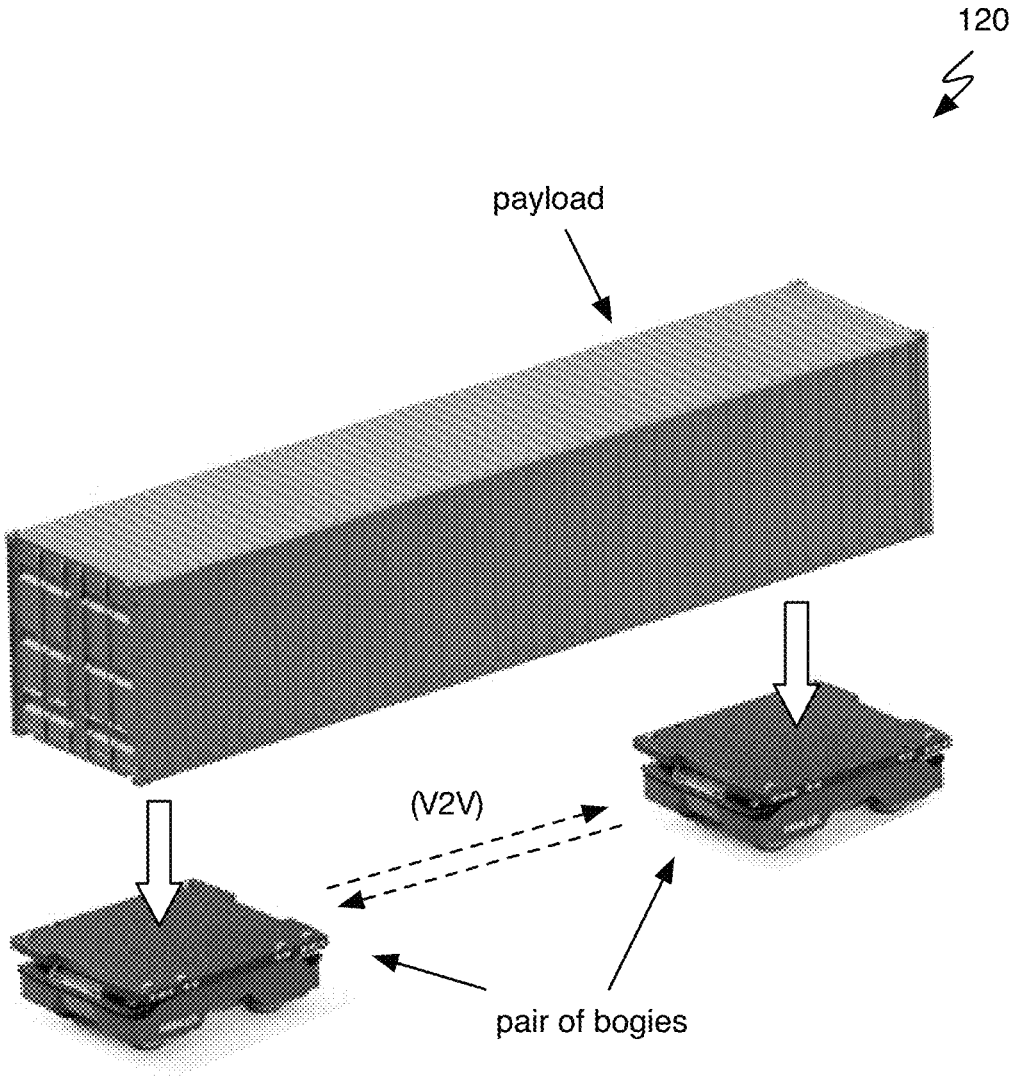
FIG. 5 is a schematic representation of a car in a variant of the system.
Figure 12:
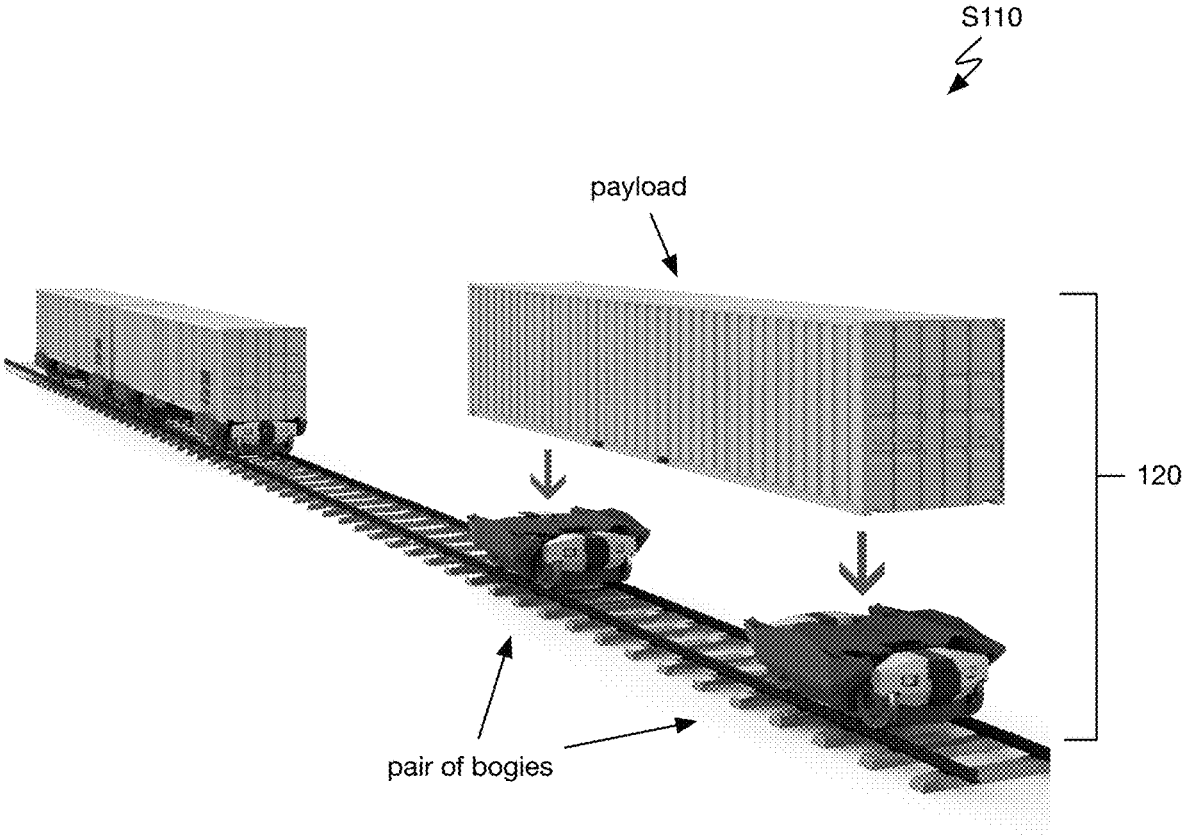
FIG. 12 is a diagrammatic example of a variant of the system.

In an example, the system and/or method can be used with an electric vehicle which can include: a payload interface, a payload suspension, a chassis, a set of bumpers, a battery, a sensor suite, a vehicle controller, an electric powertrain, a chassis suspension, and a cooling subsystem. The electric vehicle can optionally include a payload adapter and/or any other suitable components. However, the system can additionally or alternatively include any other suitable set of components. The vehicle controller can include a battery management system (BMS), motor controller (or motor inverter), and/or any other suitable components. The electric powertrain can include: an electric motor, a wheelset, and mechanical brakes. The electric powertrain can optionally include a differential (e.g., a lockable differential). However, the electric powertrain can include any suitable set of components. The electric vehicle functions to structurally support a payload—such as a cargo container (e.g., intermodal container, ISO container, etc.)—and/or to facilitate transportation of a payload via railway infrastructure. The electric vehicle is preferably an electric rail bogie and/or a rail 'module' configured to operate in a pairwise manner, such as with a pair of bogies each supporting opposing ends of a payload (an example is shown in FIG. 5). In variants, the rail bogie can be configured to support and/or transport a payload without a mechanical interconnect and/or rigid structure spanning the length of the payload (e.g., an example is shown in FIG. 12). Accordingly, the electric vehicle(s) can be cooperatively controllable in a pairwise and/or multiplicative manner, but can additionally or alternatively be individually maneuverable on a rail infrastructure. However, the electric vehicle can be otherwise suitably operated and/or controlled. The electric vehicle is preferably symmetric (e.g., has mirror symmetry across a lateral plane), and is bidirectionally operable, but can alternatively be unidirectionally operable or otherwise configured.

In a second set of variants, non-exclusive with the first set, the cars referenced in conjunction with the system and/or method can refer to a pair of the electric vehicles (e.g., and a mounted payload) as described in U.S. application Ser. No. 17/694,499, filed 14 Mar. 2022, which is incorporated herein in its entirety by this reference.

However, the system and/or method can additionally or alternatively be configured to operate with any self-propelling rail cars and/or vehicles.

The term "dispatcher" as utilized herein may refer to an automated and/or manually operated system which performs the Dispatcher role of a railway, but may be otherwise suitably refer to an operator system and/or may be otherwise suitably used/referenced (e.g., in line with Dispatcher role as defined by regulatory requirements and/or differently from Dispatcher role as defined by local/regional jurisdictions).

Similarly, term "warrant" as utilized herein may refer to a warrant as defined by a regulatory agency or may be used differently to refer to an authorized track occupancy domain (e.g., a micro-warrant; in line with warrant as governed by regulatory guidelines, separately governed from regulatory guidelines, etc.), and/or may be otherwise used.

2. Benefits

Variations of the technology can afford several benefits and/or advantages.

First, variations of the technology can increase the lengthwise density of a sequence of rail cars/vehicles. Such variations of the technology can minimize air gaps between adjacent cars and/or containers to reduce aerodynamic drag. Variations may provide superior aerodynamics when compared to automotive vehicle platooning (e.g., which provide lower lengthwise density) and conventional rail trains (e.g., which provide lower lengthwise density due to variable container sizes and rigid linkage spacing).

Second, variations of the technology can allow individual and/or collective routing of payloads (e.g., cargo containers, trailers), which can reduce downtime associated with container loading, routing, and dispatching. As an example, cars can be grouped in a platoon (e.g., for aerodynamic efficiency) and subsequently separated (e.g., during traversal of the platoon) and/or independently routed to different destinations (e.g., parallel sets of tracks, distinct rail hubs, distinct ports, etc.) for loading/unloading, which can improve the operational efficiency of a rail network. In such variants, flexibility in platoon size can enable operators to maintain a dispatch schedule at the terminal with more precisely planned meet/pass timing on the rail network, which can increase network capacity, which can be particularly advantageous to reduce costs of terminals, and which may provide benefits to both short haul and main rail corridors. For example, operators can dispatch a train at set intervals (e.g., every 20 minutes), with varying lengths of platoons depending on what payloads are ready. This can be advantageous for many freight trains operators who regularly elect to wait for the straggling payloads in order to connect them into a long train. Instead, straggling payloads can depart later, meet up with the platoon (or another platoon) during transit, and/or be otherwise controlled to reduce/eliminate any resulting downtime within the network.

Third, variations of the technology can provide and/or complement vehicle autonomy, which can reduce per-mile human operator costs, replacing the rail operator with an autonomous agent.

Fourth, variations of the technology can provide dynamic load balancing and/or energy redistribution between rail cars and/or rail vehicles (e.g., pairs of vehicles cooperatively supporting cargo of a car). Load balancing can increase the effective range of vehicles within the network and/or minimize a degradation of vehicles (e.g., vehicle batteries) within the network. Load balancing can additionally or alternatively level the SOC across vehicles within the platoon (e.g., despite non-uniform drag at various cars of the platoon and/or a drag gradient). In an example, load balancing can preserve (and/or increase) the SOC of the first vehicle within the platoon to prevent the platoon from being range limited by the first vehicle SOC (e.g., in the direction of travel).

Fifth, variants can enable coordinated accelerations and/or decelerations of a platoon. Variants can enable coordinated braking and/or platoon cohesiveness without requiring vehicle-to-vehicle communications or other V2V coordination (e.g., subsequent vehicles can regulate force into the bumper 122 and can respond to upstream perturbations without being informed digitally or by wireless radio communications). In a specific example, coordinated braking of platoons can allow a platoon (and/or cars/vehicles therein) to stop within line of sight, increasing the safety of the railway network. Additionally, in variants utilizing electric rail vehicles/cars, coordinated regenerative braking can increase the effective range and/or energy efficiency of the platoon.

Sixth, variations of the technology can be resilient to failure and/or degraded performance of vehicles and/or cars within a rail network. In a first example, a platooning car can 'push' an adjacent car having power degradation/failure with minimal or no delay in the network. In a second example, a platooning car can 'escort' an adjacent can having degradation/failure of autonomous agents, sensors (e.g., GPS), and/or communication systems.

Seventh, variations of the technology can locally maintain platoon cohesiveness and prevent inter-car gapping in a variety of operating contexts (e.g., uphill traversal, downhill traversal, traversal through ice, snow, or sand, etc.) without relying on inter-car mechanical couplings. For example, each leading vehicle (within a car) can iteratively measure a bumper contact force with the preceding car, and dynamically control the motor to maintain the contact force within a predetermined force range (e.g., wherein a minimum force threshold can be above a noise floor for the operating context, above the energy lost to friction, etc.). In this example, trailing vehicles can dynamically control their motors to maintain a payload interface force, maintain a predetermined distance from the paired leading vehicle, maintain a velocity or acceleration, or meet another operation target.

Eighth, variations of the technology can reduce and/or eliminate the need for inter-car tensile components (e.g., to transmit tensile forces between cars), train couplers, and/or air brake lines spanning between cars. Such variants can reduce the labor and/or time associated with train formation since these components are connected by manual operations. Similarly, such variants can improve reliability by eliminating components subject to failure and removing possibilities for human error.

Ninth, variations of the technology can facilitate autonomous vehicle (AV) and/or electric vehicle (EV) retrofits within an existing rail network. For example, variants can facilitate electric retrofits with battery electric rail powertrains without the expensive and time-consuming installation of third rail infrastructure (e.g., less than 1 percent of the US rail miles are currently electrified). Additionally, variants can enable existing networks to be retrofitted with AV technology (e.g., modularly on a per vehicle, car, and/or platoon basis), with minimal or no impact to the track infrastructure, dispatching, and/or other manually operated trains operating within the network.

However, variations of the technology can additionally or alternately provide any other suitable benefits and/or advantages.

3. System

The system 100, an example of which is shown in FIG. 1, can include a dispatcher 110 and a plurality of cars 120. However, the system 100 can additionally or alternatively include any other suitable set of components. The system 100 functions to enable platooning of the plurality of cars.

The cars 120 function to facilitate transportation of a payload (e.g., cargo container). In a first variant, each car includes a pair of electric bogies without a spanning structure (an example is shown in FIG. 5). In a second variant, each car is equipped with a powertrain (e.g., an electric powertrain) configured to propel the car (and payload), and is independently maneuverable/controllable, but can be otherwise suitably configured. In a specific example, the car can include two bogies rigidly coupled to a spanning structure or frame (e.g., a car body), setting a fixed longitudinal distance between the bogies (e.g., independent of a cargo size/length). In a second example, the cars can be in one or more of the configurations/arrangements as described in U.S. application Ser. No. 17/335,732, filed 1 Jun. 2021, which is incorporated herein in its entirety by this reference.

Figure 1B:
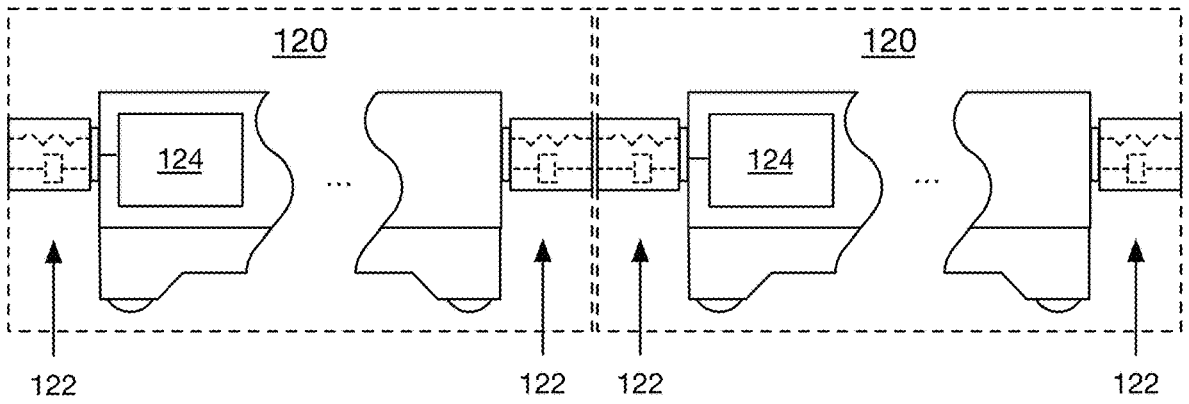

Each car can include a set of bumpers 122, an example of which is shown in FIG. 1B, which functions to dampen shock resulting from contact between adjacent cars along the rail (e.g., during S116). Additionally or alternatively, the bumper contact force/displacement can provide a measurable input for control/navigational coordination relative to an adjacent car, such as during periods acceleration, coordinated propulsion, and/or coordinated braking. Each car preferably includes bumpers at opposing longitudinal ends (e.g., at the maximal leading/trailing ends of the car).

Figure 6A:
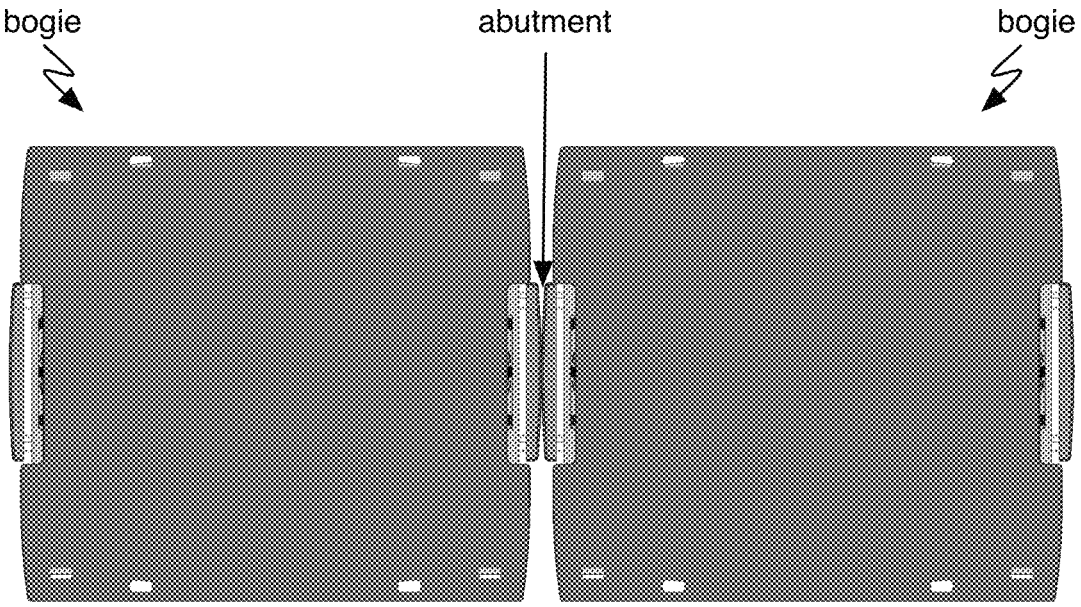
FIGS. 6A-B are a top view and a side view, respectively, of bogie abutment in a variant of the method.
Figure 6B:
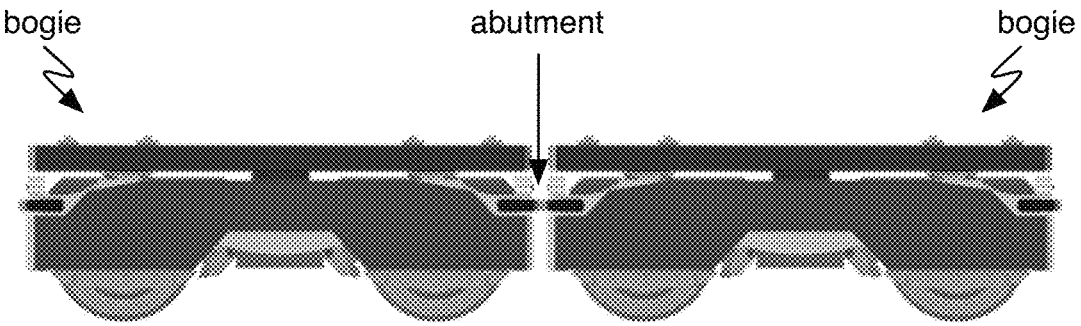

Preferably, the cars include a front bumper and a rear bumper symmetric about a frontal midplane of the car, however the front and rear bumpers can additionally or alternatively be different (e.g., having unique force vs displacement curves), asymmetric, and/or otherwise suitably configured. Alternatively, the car can exclude a front and/or rear bumper, and/or can be otherwise suitably configured. Preferably, each bumper is symmetric about a midsagittal plane of the car and connects to the chassis at two points which span an element of the payload suspension. Alternatively, each bumper can mount in the center (e.g., along a longitudinal centerline) and direct force down the spine of the car (or a bogie therein). However, the bumper(s) can be otherwise suitably arranged. The contact surfaces of bumpers (e.g., along the leading edge of a forward bumper or trailing edge of a rearward bumper; examples of bumper abutment are shown in FIGS. 6A and 6B) are preferably arcuate, but can be otherwise suitably configured.

In a specific example, the span and/or curvature of each bumper can be specified based on the maximum curvature of a standard rail and/or the maximum angle between adjacent payloads/cars on a maximally curved rail. Alternatively, the abutment surfaces of the bumpers (at leading and/or trailing ends) can be planar and/or have any other suitable geometry.

In variants, cars can optionally include un-utilized, interior bumpers arranged between wheel sets. In a specific example, a car can include two bogies, each bogie including a pair of bumpers symmetrically opposing in the longitudinal direction. Based on the arrangement of cargo on the bogie (e.g., determined in S105), the outward-facing bumper(s) can be utilized for force-feedback control (e.g., in S230). In some variants, the forward-oriented bumper (e.g., based on the direction of motion of the car) can be utilized for vehicle control, and rearward (and/or interior-oriented) bumpers can be neglected.

In variants, it can be desirable for bumpers to readily displace across a first force regime (e.g., shallow slope of a force vs displacement curve, low spring constant; for abutment sensing/coordination) while providing shock resilience across a second force regime (e.g., high spring constant—such as greater than 10 times the spring constant of the first force regime). In a specific example, bumpers can react and/or sense both a 500N contact load during platooning and a 10 kN (e.g., up to about 25 kN) shock load during initial contact with the platoon (e.g., at speed, such as while traversing at 20 mph, 40 mph, 60 mph, etc.). In a second example, bumpers can sense contact loads/forces within a first (lower end of the force regime), while having additional dynamic damping range (e.g., beyond the bounds of force sensing; wherein the span of the sensing range is less than a threshold fraction of the total displacement range, such as 50%, 25%, 10%, etc.) to provide resilience to higher forces and/or shock loads.

Figure 8:
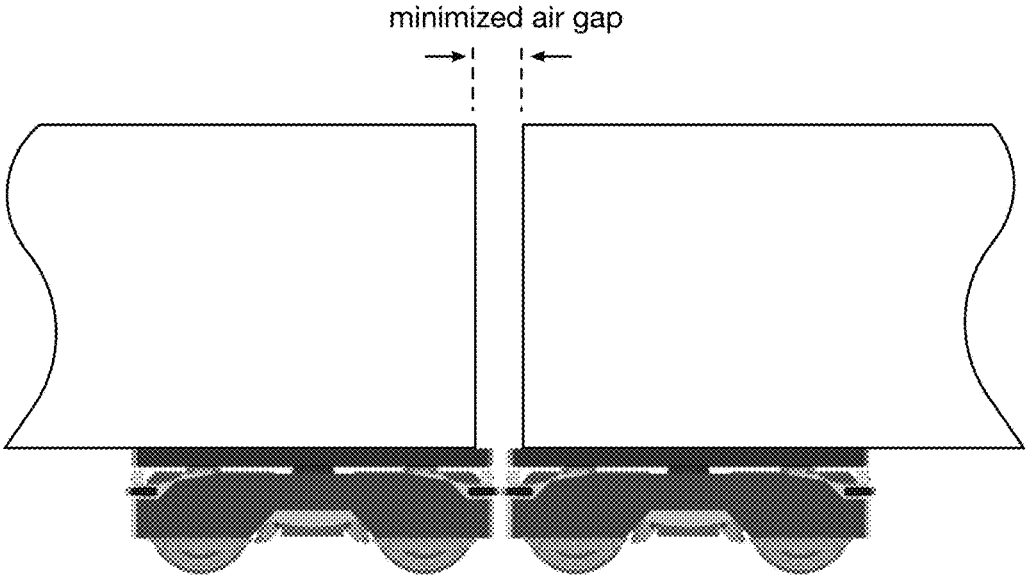
FIG. 8 is a partial side view representation of a variant of the system.

In variants, providing bumpers which are overdamped and/or critically damped across a full range of dynamic loads—based on payload mass range (e.g., 0 kg to 50,000 kg) and relative velocity at initial contact (e.g., 0.1 m/s, etc.)—can disadvantageously increase a length requirement and/or displacement range of bumper spring/damper systems (and may additionally impart large forces upon initial contact/shock). In such variants, it can be preferable to limit a longitudinal air gap to about 18 inches which can limit a bumper displacement range to about 4 inches (8 inches combined displacement of symmetrically opposing bumpers of abutting cars; an example is shown in FIG. 8). Instead, by underdamping the bumpers relative to the full dynamic range and relying on coordinated active damping (e.g., by the electric powertrain) during initial contact, the length of the bumpers and/or the displacement range of the bumpers can be reduced, thereby reducing the effective air gap of the platoon. However, the bumpers can be underdamped, otherwise damped, and/or undamped (e.g., employed without a dedicated damping component).

The bumper 122 can be damped and/or sprung: axially (e.g., in the direction of bumper compression) and/or laterally (e.g., mitigating out-of-plane contact loads arising from rail curvature). The bumper can include circumferential damping elements, axial compression elements (e.g., coil springs), and/or any other suitable components. Damping elements can be hydraulic, pneumatic, rubberized, spring steel, and/or any other suitable type(s) of damping elements.

The bumper 122 can include any suitable force and/or displacement sensors (e.g., as part of the sensor suite), such as: load cells, strain gages, proximity sensors (e.g., optical, laser range finders, etc.), and/or any other suitable sensors of the sensor suite. The sensor can be sensitive to forces and/or displacement over a wide range (e.g., across all or a majority of the bumper's operational contexts), across a narrow range (e.g., wherein the bumper includes multiple sensors, each with a different measurement range, that cooperatively encompass the bumper's operational context), and/or across any other suitable set of ranges. The sensors can be the damping element, be mounted within the damping element, be mounted adjacent to the damping element, or be otherwise arranged.

However, the car(s) can include any other suitable bumper(s).

Each car can include a sensor suite 124 which functions to facilitate traversal according to the method S100. The sensor suite can additionally function to monitor vehicle state parameters which can be used for vehicle control (e.g., autonomous vehicle control). The sensor suite can include: internal sensors (e.g., force sensors, accelerometers, gyroscopes, IMU, INS, temperature, voltage/current sensors, etc.), external antennas (e.g., GPS, cellular, Bluetooth, Wi-Fi, Near Field Communication, etc.), rail sensors (e.g., wheel encoders, cameras, temperature sensors, voltage/current sensors, accelerometers, etc.), payload sensors (e.g., force sensors/switches, cameras, lights, accelerometers, NFC sensors, etc.), environmental sensors (e.g., cameras, temperature, wind speed/direction, accelerometers), guidance sensors (e.g., load cells, bumper contact switches, strain sensors, lights, horn, sonar, lidar, radar, cameras, etc.), and/or any other suitable sensors. The sensors can include one or more: radar sensors, lidar sensors, sonar sensors, cameras, spatial sensors, location sensors, force sensors, on-board diagnostic sensors such as vehicle mechanism sensors, audio sensors, barometers, light sensors, temperature sensors, current sensors, air flow meters, voltmeters, contact sensors, proximity sensors, vibration sensors, ultrasound sensors, electrical sensors, and/or any other suitable sensors. However, the car can include any other suitable sensors.

In variants, one or more sensors of the sensor suite can be oriented towards the payload and arranged at a periphery of the car (e.g., corners, sides, front, rear, etc.), such as to enable wireless connectivity.

In variants, cars can include electrically decoupled sensor suites and/or powertrains, such as may be distributed between a pair of bogies. In such variants, the sensor suite can enable near field communication and/or wireless connectivity (e.g., V2V communication) between the bogies of a car.

However, the system can include any other suitable sensor suite.

However, the system can include any other suitable car(s).

The dispatcher functions to provide instructions to the car(s). The instructions can include a warrant (or authorized track occupancy domain) allowing a rail unit to occupy a region/segment of track (e.g., within a rail network). Additionally or alternatively, the warrant can be automatically determined (e.g., determined based on the location and physical extent of a rail unit that is already on the track), assigned by an automatic warranting system, assigned by another vehicle (e.g., a train), and/or otherwise determined. A rail unit can be a car or aggregation thereof (e.g., set of cars; platoon), separated from other rail units by more than a threshold distance. For example, the rail unit can be an individual bogie (e.g., independently actuatable/maneuverable bogie, such as a battery-electric rail bogie), a car (e.g., a pair of rail bogies and a payload, etc.; an independently actuatable/maneuverable rail car, etc.), a platoon, and/or any suitable combination thereof. The threshold distance can be determined based on: GPS inaccuracy, the rail unit's kinematics (e.g., inertia, acceleration, velocity, etc.), the operating environment (e.g., terminal, between terminals, etc.), be a predetermined distance (e.g., 20 m, 30 m, 50 m, 5 m, etc.), and/or can be otherwise determined. Preferably, only a single warrant is issued to each rail unit for a distinct region of track at a given time and each rail unit is only able to operate within the bounds of track region specified by the warrant. The warranted track region is preferably static (e.g., and reassigned to each rail unit over time), but can alternatively move over time (e.g., move along the track, in the direction of rail unit travel). The warranted track region is preferably nonoverlapping with other warranted track regions for the same time period, but can alternatively overlap. Warranting can be used to create the platoon (e.g., wherein warrants for leading and trailing rail units get closer over time until they platoon, at which point a single larger warrant is assigned to the platoon; join a car or plurality of cars to a platoon), separate the platoon (e.g., wherein a single platoon warrant is split into multiple warrants, each assigned to a different platoon subsegment), and/or otherwise used for control. Warrant parameters (e.g., location, movement, time, duration, rail extent, etc.) can be manually determined, automatically determined (e.g., using a model configured to construct and/or deconstruct platoons), and/or otherwise determined. Alternatively, multiple car(s) and/or platoon(s) can traverse a common section of track during S220 (e.g., in order to merge with a second car and/or platoon; treated cooperatively as a single platoon; etc.), and/or any other suitable warrants can be provided. The instructions can additionally or alternatively include operation mode commands for the rail unit (e.g., master/slave assignment, leading/trailing, etc.), speed commands (e.g., a speed target), acceleration commands, position commands (e.g., waypoints along the track with associated time targets), and/or any other suitable commands associated with a car (or an individual bogie thereof) and/or platoon. In some variants, the rail unit/car may operate based on the instructions (e.g., a warrant) without the use of track circuits for localization of the vehicle on the track (e.g., which may reduce operation and/or retrofit requirements in some contexts; however alternatively the rail unit/car may use track circuits for localization relative to the track. In variants, the instructions from the dispatcher can additionally or alternatively command load balancing and/or energy redistribution between cars (and/or bogies therein) of a platoon. Alternatively, one or more cars (or independently-actuatable vehicles thereof) can coordinate load balancing of the platoon (e.g., by V2V communications) or energy can be managed independently for each car and/or energy system of the platoon. However, the dispatcher can provide any other suitable set of instructions.

Figure 13:
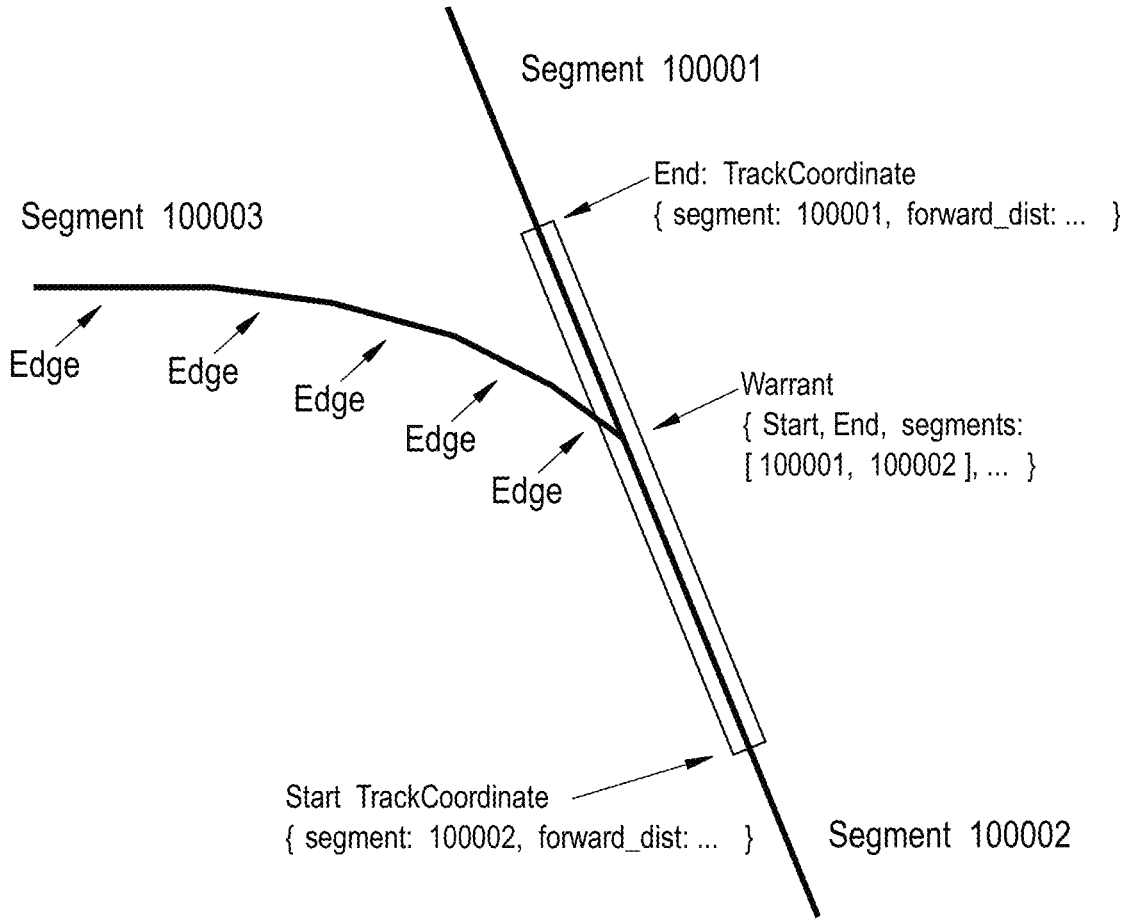
FIG. 13 is a diagrammatic example of a warrant in a variant of the system and/or method.

In variants (an example is shown in FIG. 13), warrants can include: a start coordinate along a track, and end coordinate along a track, a list of (sequential) segments (e.g., included in the warrant and found between the start and end coordinates), and can optionally include metadata (e.g., a speed limit for the section(s) of track). In such cases, a rail network can be a sparse network consisting of edges (e.g., portions of the track that can be approximated as a straight line), segments (e.g., sequential sets of edges), nodes (e.g., a location where two or more segments meet at a single point; two segments can meet at a crossing, 3 segments can meet at a switch; etc.).

However, warrants can be otherwise issued and/or a rail network can be otherwise modeled/coordinated.

The dispatcher can be centralized and/or distributed (e.g., multiple compute nodes), specific to a rail line or shared between rail lines, or otherwise configured. The dispatcher can be a human, a human operated system, an automated system, and/or any other dispatcher. In variants, the dispatcher can redundantly compute and/or communicate instructions to cars and/or platoons, such that the system can be resilient to failure of one or more compute nodes and/or communication nodes. The dispatcher can communicate with each bogie, car, and/or platoon (and/or each autonomous processor/agent therein). In a specific example, the dispatcher can communicate with a subset of cars (e.g., leading car of a platoon in the direction of travel; cars traversing individually S210) as part of a vehicle-to-infrastructure (V2I) communication channel. The subset of cars can be configured to control a remainder of cars within the platoon, such as by a vehicle-to-vehicle communication channel and/or by a mechanical interface (e.g., force transmission at bumper contact).

In variants, the dispatcher can provide instructions to (and/or warrants for) multiple cars and/or platoons operating within a single rail network (e.g., along a single track). For instance, the dispatcher may provide instructions to all rail cars and/or platoons operating within a rail network (e.g., a fully autonomous and/or fully automated network) or a subset thereof. The dispatcher can provide instructions to multiple platoons and/or rail cars simultaneously, synchronously, asynchronously, and/or with any other communication frequency/relationship. However, the dispatcher can provide any other suitable instructions with any other suitable timing.

In variants, the dispatcher can provide instructions which include speed (and/or velocity) target. As an example, the lead car of a platoon can be controlled based on the speed target, and each (independently-maneuverable) car trailing the lead car may achieve the speed target with torque control based on a compressive force target (at the leading bumper).

However, the system can include any other suitable dispatcher.

However, the system can include any other suitable components.

Figure 10:
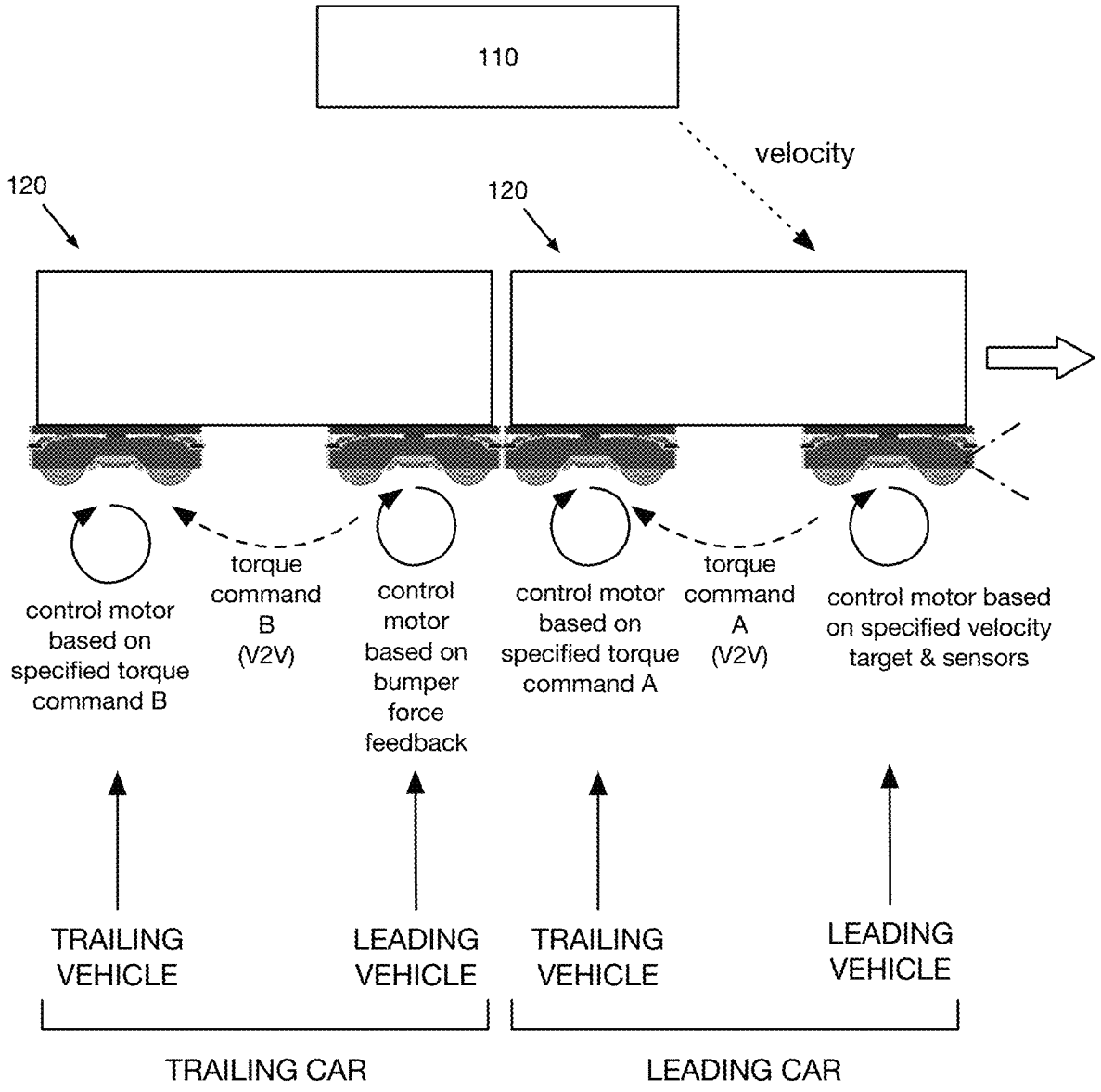
FIG. 10 is an illustrative example of local vehicle control.
Figure 11A:
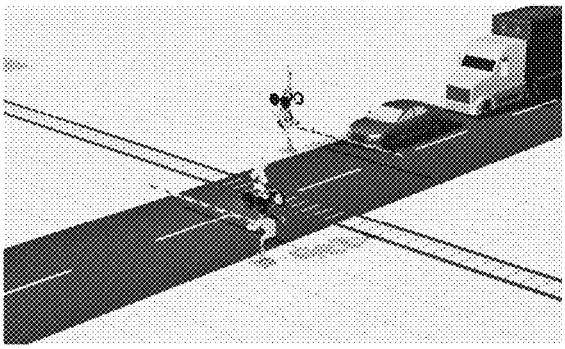
FIGS. 11A-F is an example sequence of splitting a platoon in a variant of the method.
Figure 11B:
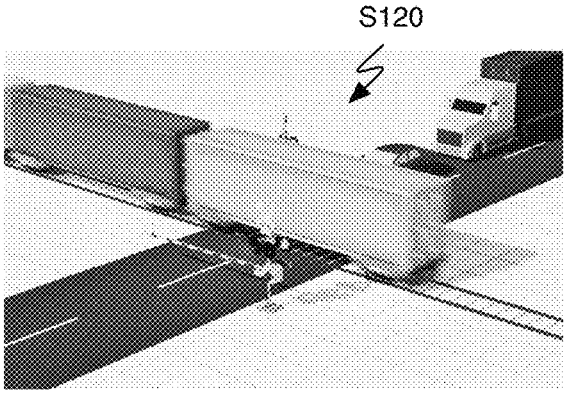
Figure 11C:
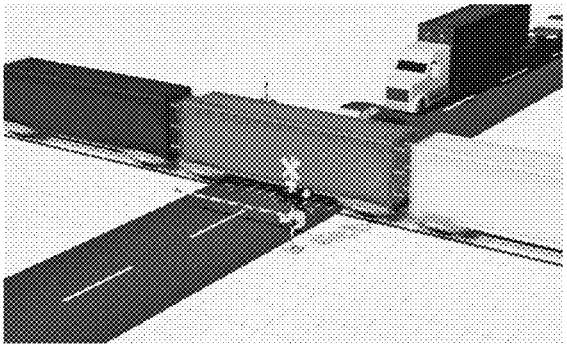
Figure 11D:
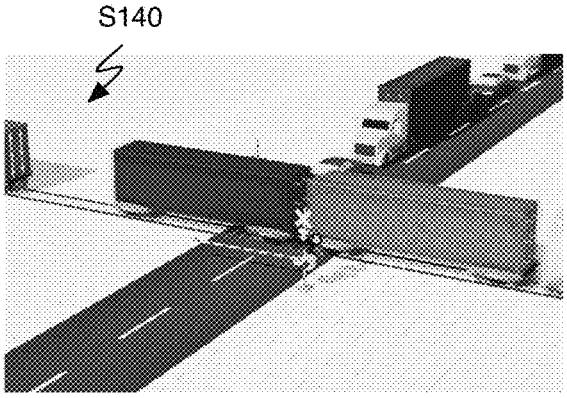
Figure 11E:
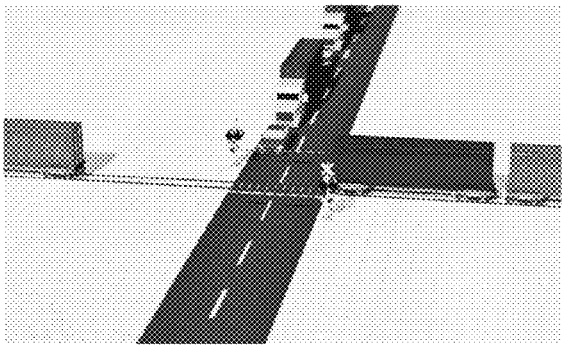
Figure 11F:
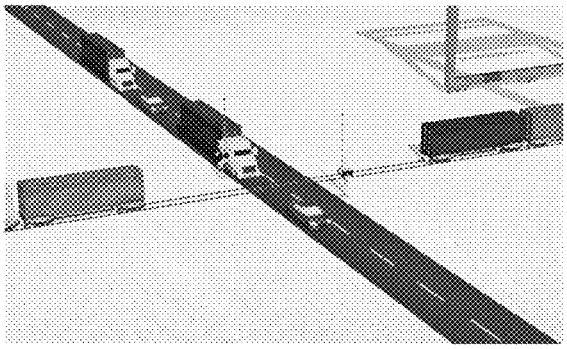

In some variants, cars can be commanded, controlled and/or receive instructions based on an arrangement of rail vehicles within each car (e.g., where a car includes a plurality of independently-actuatable rail vehicles, such as a pair of battery-electric rail drones cooperatively supporting a payload). The arrangement of vehicles can specify which vehicle of the car directs traversal according to the instructions (an example is shown in FIG. 2B; a second example is shown in FIG. 10). The arrangement of vehicles within a car can be determined: manually, based on a cargo loading sequence, based on a warrant assignment of the vehicles prior to car formation (e.g., before connecting cars by via a payload), based on relative GPS position, based on an interior bumper contact sequence (e.g., contacting interior bumpers which are unused after formation of the car), and/or based on a database reference. However, the arrangement of vehicles within a car can be otherwise suitably determined.

Vehicle operation can be coordinated within a car, coordinated within a platoon, independently controlled, and/or be otherwise controlled. Vehicle operation can be determined based on the vehicle's operation mode (e.g., leading vehicle, trailing vehicle), be determined by a coordinator (e.g., vehicle within the car or platoon designated as the master, wherein the other vehicles are designated as slaves), or otherwise determined. In a first example, based on the arrangement of vehicles within the car and the direction of travel, the leading vehicle determines control instructions for the car. In the first example, the leading vehicle can communicate instructions to the remaining (trailing) vehicle via a V2V communication channel (e.g., wireless transmitting torque/speed commands) and/or via mechanical force transmission (e.g., with the trailing vehicle operating in a torque control mode). In a second example, the lead vehicle can set a car velocity (e.g., based on bumper force sensor feedback), wherein the trailing vehicle can maintain a payload shear force (e.g., measured at the platform interface) within a predetermined range. In a third example, the trailing vehicle can be controlled to a predetermined fraction (e.g., half) of the average torque (e.g., rolling, weighted, etc.) of the leading vehicle within a car, which can prevent the vehicles from supplying conflicting torques in the event of speed measurement errors (e.g., due to different wheel wear). In a fourth example, the trailing vehicle can be controlled based on the compressive force at the leading bumper of the leading vehicle. In a fifth example, the leading vehicle regulates a target parameter (e.g., speed in the case of the leading car; bumper contact force in the case of trailing cars), and the rear drone is set to average out the load with a low update rate. In such cases, the nominal impact of low rate V2V communication/response is SOC variation between paired vehicles, which can be marginalized by load balancing and/or otherwise neglected in many cases. In alternative variants, the leading vehicle can be considered the 'master' vehicle and the trailing vehicle can be considered a 'slave' vehicle, controlled based on a V2V commands from the associated/paired 'master' vehicle. However, pairs of vehicles in a car can coordinate based on the instructions in any suitable manner.

4. Method

Figure 2A:
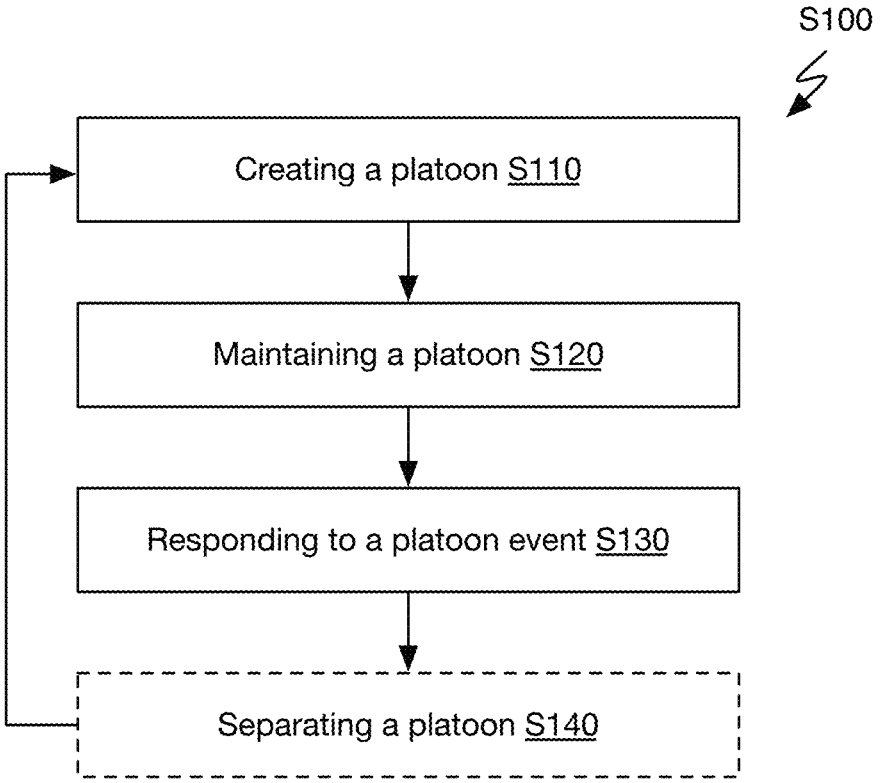
FIG. 2A-C is a diagrammatic representation of a variant of the method.
Figure 2B:
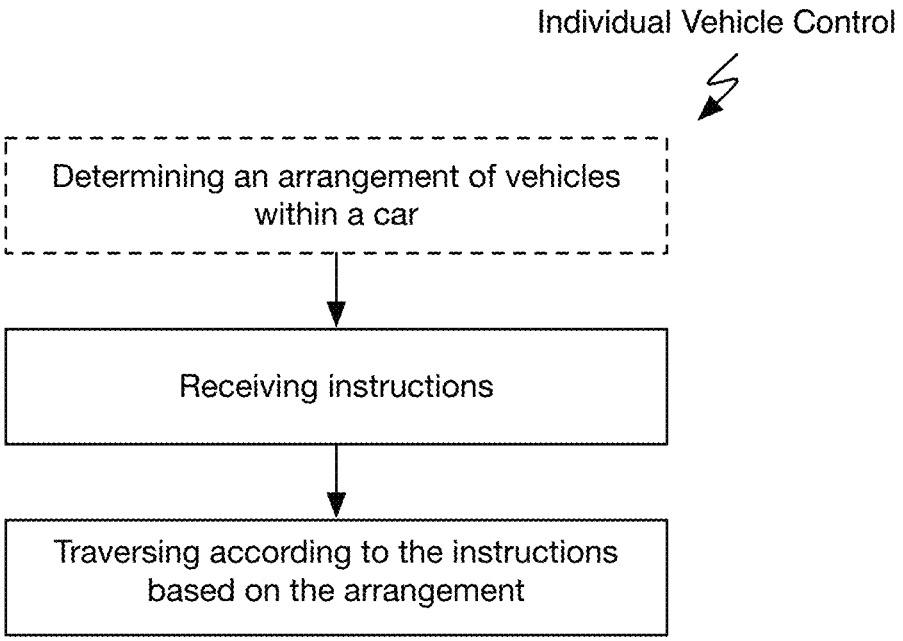

The method S100, an example of which is shown in FIG. 2A, can include: creating a platoon Silo; maintaining a platoon S120; responding to a platoon event S130; and separating a platoon S140. However, the method S100 can additionally or alternatively include any other suitable elements. The method S100 functions to facilitate cooperative transportation (platooning) of a plurality of payloads by way of the cars. The method S100 can be performed once, continuously, repeatedly, and/or with any other suitable timing/periodicity for any suitable cars and/or platoons within the network (e.g., as the dispatcher controls one or more cars and/or platoons operating on a rail network, etc.). Method sub-elements can occur in any suitable combination and/or permutation, and/or can be otherwise suitably performed.

Creating a platoon S110 functions to facilitate cooperative transportation of a plurality of payloads (e.g., which may improve aerodynamic characteristics during transit). Platoons can be created manually and/or automatically at terminals (e.g., during loading and unloading; during formation of cars from constituent vehicles and payloads). Platoons can additionally or alternatively be created between terminals (e.g., for cars traveling along a common track). Platoons can be created by joining a stationary set of cars and a moving car(s) or by joining two sets of cars traversing in the same direction along a common track (e.g., controlling the sets of cars at different relative speed/velocity and/or based on a relative speed/velocity threshold; etc.). Platoons are preferably created autonomously and/or automatically by the cars based on the instructions received from the dispatcher, but can be otherwise created based on instructions from a car or vehicle (e.g., relaying instructions from a dispatcher, autonomously generating instructions, based on a warrant assignment, etc.) or otherwise created.

Figure 2C:
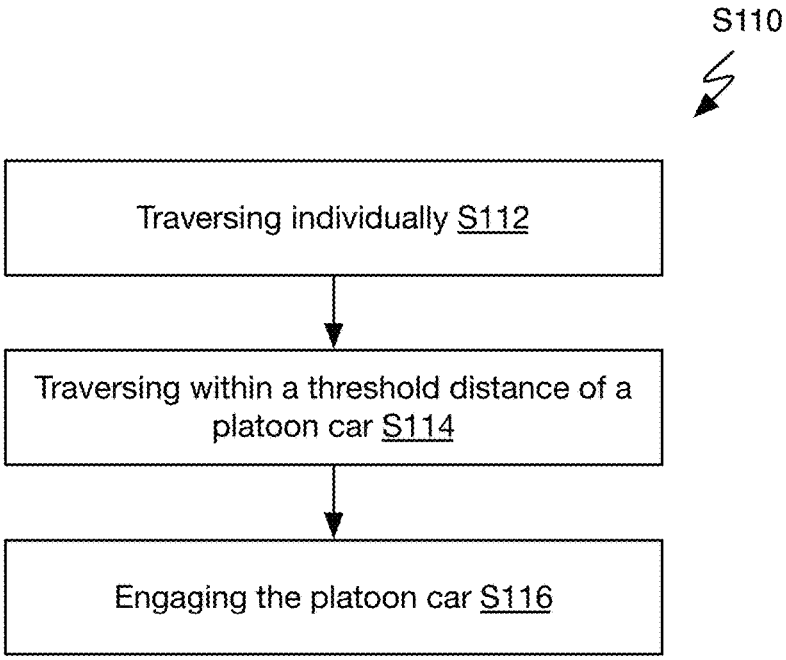

Creating a platoon Silo, an example of which is shown in FIG. 2C, can include traversing individually S112, traversing within a threshold distance of a platoon car S114, and engaging the platoon car S116. However, creating a platoon can include any other suitable elements.

Figure 4A:
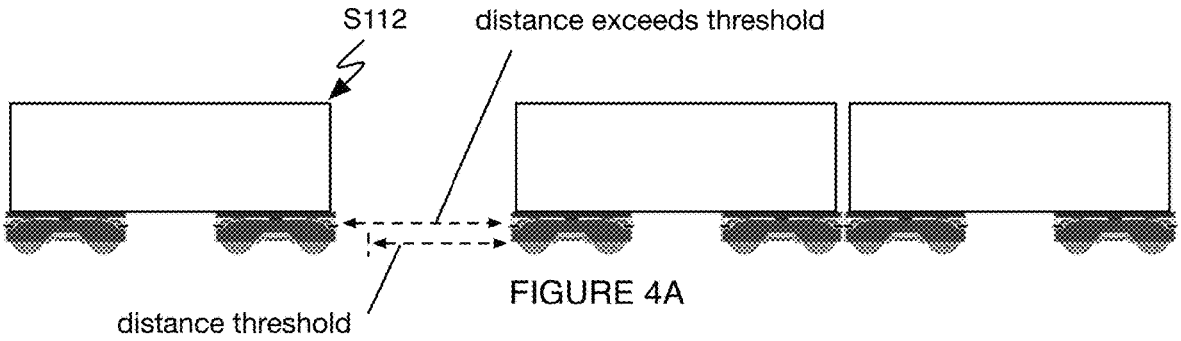
FIGS. 4A-D are diagrammatic representations of an example sequence of method elements in a variant of the method.

Traversing individually S112 functions to reduce a distance between the sets of cars occupying the same track (an example is shown in FIG. 4A). The cars traversing during S112 can include platoons (e.g., traversing according to S120), a set of cars, and/or individual vehicles/cars. The sets preferably traverse at different speeds, with a relative speed serving to close the gap between the two sets. In a first example, a car can move towards a stationary platoon in a first direction (e.g., to escort the platoon in a second direction opposing the first direction; to push the platoon in the first direction; etc.). In a second example, the first (leading) and second (trailing) sets of cars can move in the same direction, the leading set traversing with a first speed, the trailing set traversing at a second speed greater than the first speed.

In S112, each set of cars occupies a different unique section of track and operates under a separate warrant. The sets of cars are separated/offset by at least a threshold distance (e.g., 20 meters). The threshold distance can be predetermined (e.g., fixed within the rail network, by the dispatcher warrant assignments, based on a predetermined maximum speed of cars operating in the rail network, etc.), dynamically determined (e.g., based on the speed, stopping distance, localization granularity, size of the warrant, density of rail network, etc.), manually determined, and/or otherwise suitably determined. During S112, each set can be individually responsible for determining and/or responding to events (e.g., which may require accelerations/decelerations, full stop, etc.), such as a detection of hazards on or around the track (e.g., detection of pedestrians, automobiles, down powerline, etc.). During S112, each set can separately communicate with the dispatcher (e.g., without V2V communications between the two sets; receiving instructions) continuously, periodically, aperiodically, and/or not communicate with the dispatcher (e.g., over an interval, while operating within the warranted section of track).

However, the sets can otherwise close the distance therebetween.

Figure 3:
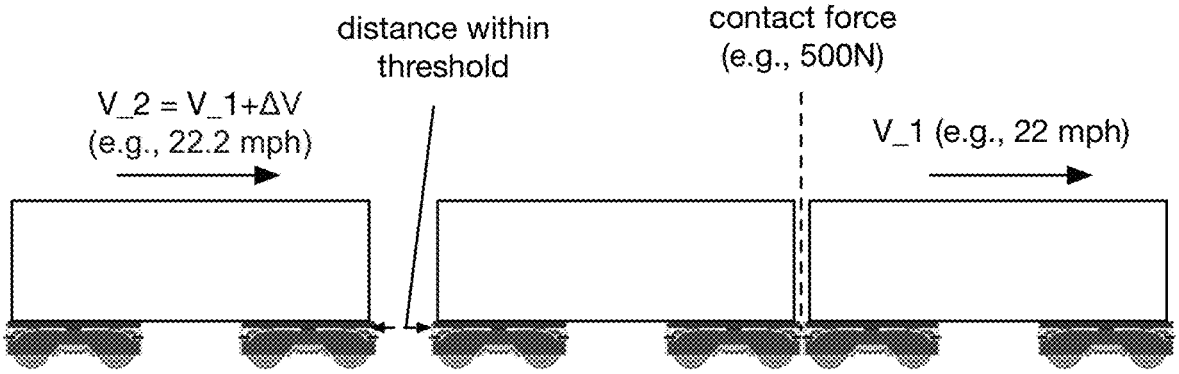
FIG. 3 is a diagrammatic representation of a variant of the method.
Figure 4B:
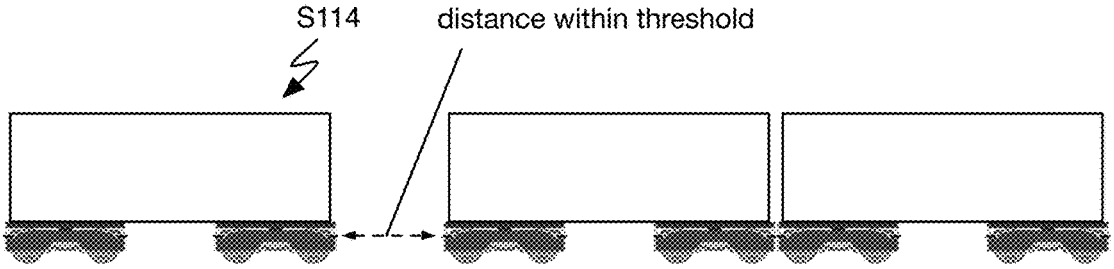

Creating a platoon S110 can include traversing within the threshold distance of a platoon car S114, which functions to close a distance between the sets of cars during creation of the platoon (examples are shown in FIGS. 3 and 4B) and/or mitigate shock of engagement (e.g., of S116). In S114, the relative speed of the sets is preferably decreased from the relative speed in S112. The relative speed/velocity can be set at a fixed speed delta (e.g., based on shock constraints of the car and/or bumpers, based on operating speed of rail network, etc.), ramped down, and/or otherwise suitably controlled. In S114, one or both sets of cars can communicate with the dispatcher via a V2I channel and/or the sets can communicate with each other via a V2V channel. The set of cars traveling at greater speed (e.g., closing the gap) can be configured to sense and/or estimate the remaining distance between the sets based on measurements from any suitable set of: time-of-flight sensors (e.g., radar), GPS sensors, optical sensors (e.g., camera; detecting fiducials of the adjacent car), vehicle sensors (e.g., inertial sensors, wheel speed sensors, motor torque/speed sensors, etc.), and/or other sensors and adjust the relative speed and/or control appropriately. Alternatively, the slower set of cars can speed up, the faster set of cars can slow down at a predetermined time (e.g., calculated to approximate the threshold distance), a physical buffer (e.g., a bumper) can be deployed, a magnetic bumper can be activated, and/or the set of cars can be otherwise controlled to achieve and/or maintain the threshold distance.

In such variants, the 'closing' set of cars (the set of cars approaching the remaining set) can be controlled to minimize a relative speed difference between the sets of cars (e.g., within a predetermined threshold speed/velocity difference), minimize a shock load and/or initial force between bumpers (e.g., within a predetermined threshold, such as based on a maximum force and/or displacement threshold of the bumper), minimize a closing duration (e.g., in which both sets of cars occupy the same warrant, in which the closing car is within a predetermined distance of the other set of cars), minimize a risk score (e.g., determined based on one or more sensors, a distance between the cars, a current speed, a minimum braking distance, etc.), and/or can be otherwise suitably controlled.

Additionally or alternatively, the set of cars traveling at greater speed can be operated in a force feedback loop, immediately entering S116 in response to detecting a contact force at the bumper (proximal the platoon car; leading bumper in the direction of travel) in excess of a threshold. However, the slower car set can alternatively control the relative speed.

During S114, both sets of cars can share a warrant and/or can be configured to cooperatively respond to platoon events, such as hazards on the track. In a specific example, when a trailing car is within a threshold distance of a leading car, the trailing car may have a reduced ability to observe hazards ahead. Accordingly, the trailing car can be configured to respond (e.g., brake) in coordination with the leading vehicle—such as by observing and adjusting control in response to a change in the leading vehicle speed, or by receiving an instruction (e.g., via a V2V channel) associated with coordinated braking.

In a first example, S114 can terminate when contact is established between the two sets of cars.

In a second example, S114 can terminate according to S140—such as by braking a trailing vehicle or accelerating the leading vehicle until the distance between the vehicles exceeds the threshold distance, at which point the first and second sets are assigned separate warrants. S114 can terminate in response to a trigger—such as a hazard and/or event detection based on onboard sensors, relative speed difference satisfying a trigger threshold, a vehicle acceleration satisfying a threshold, and/or any other suitable event—and/or a communication (V2V) from the platoon.

Alternatively, both sets of vehicles can remain within the warrant and rely on coordinated behavior to maintain S114 even in response to a hazard or trigger events.

However, the distance between the sets of cars creating the platoon can be otherwise suitably closed.

Figure 4C:
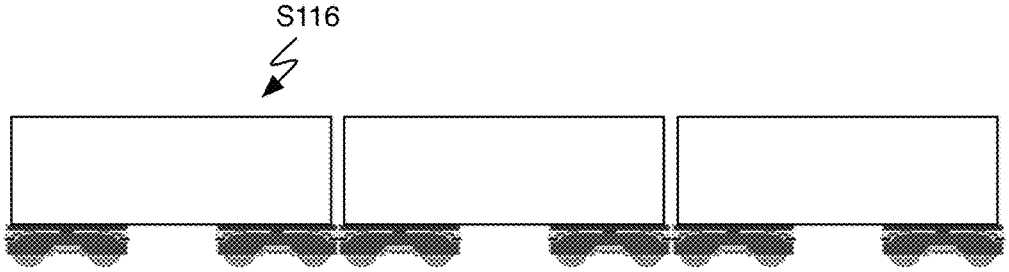

Creating a platoon S110 can include engaging the platoon car S116, which functions to dampen the shock of engagement and/or equilibrate the contact force between the two sets of cars forming the platoon (an example is shown in FIG. 4C). The shock is preferably dampened passively by the bumper(s) but can additionally or alternatively be actively dampened based on the measured contact force at the bumper (e.g., load cell) and/or frame accelerations of the car/payload. In a specific example, the set of cars moving at higher speed can actively dampen the shock of engagement by regeneratively braking an electric motor of a car (vehicle) powertrain, based on the contact force at the bumper. In S116, one or both sets of cars preferably transition into a force feedback and/or torque control mode (e.g., as opposed to a speed control mode), until the contact force equilibrates within a range as specified by S120.

Platoons can be created from any suitable sets of cars. In a first example, a platoon can be formed by merging/joining two platoons, each including a respective plurality of cars. In a second example, a platoon can be formed by merging/joining a first and a second individual car. In a third example, a platoon can be formed by merging/joining an individual car and an existing platoon including a plurality of cars.

However, platoons can be otherwise created/formed from sets of cars.

In a first example, a platoon can be created and/or a car can be joined/merged with a platoon when the distance between the car and an adjacent car of the platoon is zero (i.e., the car physically abuts an adjacent car of the platoon, such as a trailing car or leading car; bumper abutment is established, etc.). In a second example, a car may be joined/merged with a platoon once the car is assigned to the same warrant and/or is cooperatively controlled with the remaining cars of the platoon (e.g., in accordance with S120 and/or S130). In a third example, a car may be joined/merged with a platoon once the air gap at a leading end of the car is minimized (e.g., for the particular car configuration). In a fourth example, a car may be joined/merged with a platoon based on a relative velocity threshold being satisfied (e.g., cars are traversing at substantially the same speed; velocity difference of less than 0.2 km/h in a direction of traversal; etc.). In a fifth example, a car may be joined/merged based on any combination or permutation of the first, second, third, and fourth examples.

In variants, platoon creation and/or assignment of a specific car (or rail drone) to a particular platoon, position within the platoon, and/or warrant may be based on factors like proximity, state of charge, line of sight, time for relocation, cargo weight, a number of moves (for example spur switches) for relocation. Additionally or alternatively, platoon creation and/or warrant assignment can be performed by a dispatcher (e.g., according to any suitable set of criteria).

Maintaining a platoon S120 functions to enable cooperative traversal of the cars of a platoon along a section of track. Maintaining a platoon can additionally or alternatively function to exchange instructions between the cars of the platoon (mechanically) and/or distribute power/energy between cars of the platoon. In S120, the platoon traverses along a section of track in a direction according to instructions received by the dispatcher. The instructions can specify: a warrant (or region of track), a speed/velocity command, a position command, a contact force command, and/or any other suitable commands. The platoon can traverse in the same direction as the direction of engagement in S110 (e.g., a car or plurality of cars can join at the rear and continue in the same direction) or the opposite direction. The instructions are preferably received at a lead car based on the direction of traversal, but can additionally or alternatively be received at each car (and/or vehicle) of the platoon.

Based on the instructions, the lead car in the direction of motion can control the traversal of the platoon (e.g., speed, acceleration, position, etc.). The lead car is preferably autonomously operated, but can otherwise be manually operated or remotely controlled. The remaining (trailing) cars of the platoon are controlled by continuously maintaining a contact force at the lead bumper of the respective car (i.e. a 'push') in any suitable control scheme (e.g., feedback loop), example shown in FIG. 10. The contact force to maintain the platoon can be received as part of the instructions over: V2I channel (e.g., from the dispatcher), V2V channel from one or more cars of the platoon (e.g., from the lead car, from an adjacent car, etc.), and/or otherwise suitably received. Additionally or alternatively, the contact force can be predetermined (e.g., fixed, 500N, between 100N and 1000N, etc.), dynamically determined (e.g., adjusted based on the platoon speed, acceleration, etc.) and/or otherwise suitably determined. The platoon can thus be dynamically coordinated using the contact forces independently of wireless/wired communication channels. In a specific example, the actuation time constant for each car in this configuration can be on the order of 100 Hz, based on a time constant of load cell measurement of the contact force occurring on the order of ~kHz, powertrain torque regulation on the order of ~1 kHz, and stiffness of the car (excluding bumper) reacting on the order of about 1 to 10 Hz; where disturbances acting to accelerate/decelerate the car and/or deform the bumper occur on the order of about 0.1 to 1 Hz.

In this configuration, accelerations/decelerations of the lead car (and/or a lead vehicle thereof) are mechanically communicated (sequentially) along the platoon to coordinate traversal. Where contact is limited to compressive contact (e.g., 'pushing' at the front end of cars), control can be mechanically communicated opposite the direction of motion (e.g., unidirectionally; rearwards along the platoon). However, cars can additionally or alternatively be controlled based on the contact force from the rear relative to the direction of motion and/or based on wireless communication of any suitable instructions rearwards, forwards, bi-directionally, and/or between any suitable set of cars of the platoon.

However, in variants, the contact and/or engagement between cars can additionally or alternatively include tensile load transmission (i.e. 'pulls'), and/or can be otherwise suitably configured.

Figure 7:
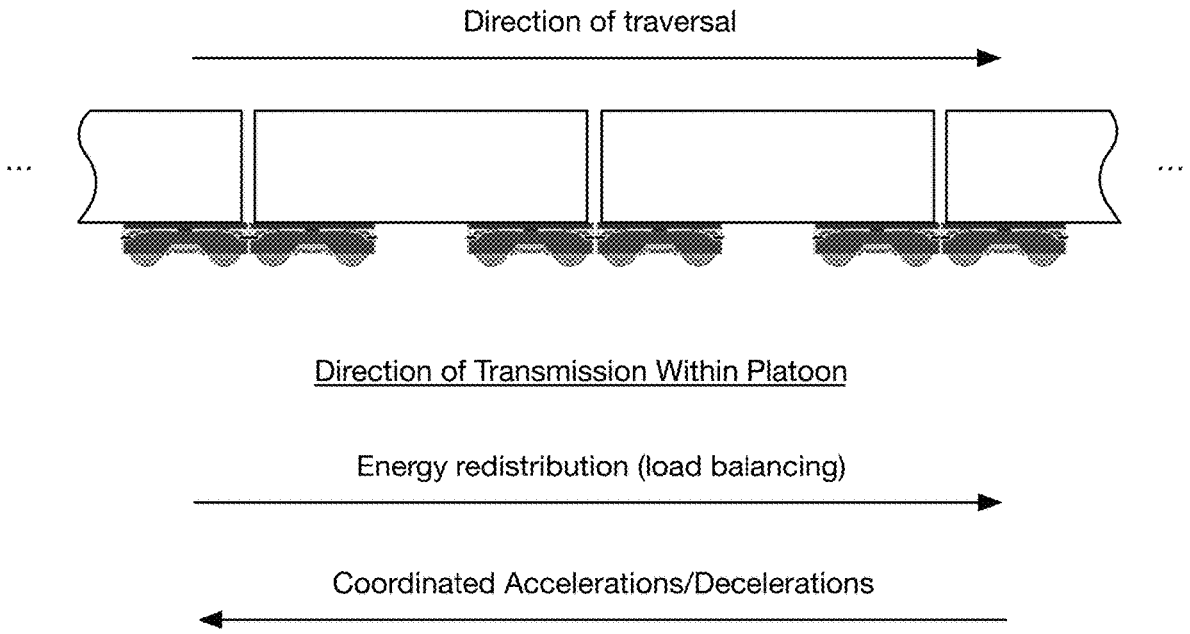
FIG. 7 is a diagrammatic representation of a variant of the method.

In variants, maintaining contact at the leading bumper of each vehicle can include load balancing and/or energy redistribution between cars of the platoon, such as by adjusting the contact forces at the leading and/or trailing ends (bumpers) of a car based on the state of charge, which may function to extend the (electric) range of the platoon and/or improve performance characteristics (e.g., overly depleting a battery may have adverse effects on battery life, efficiency, etc.). For example, cars can: push on leading cars (e.g., reducing the energy expenditure of the leading car), pull on trailing cars (e.g., reducing the energy expenditure of the trailing car), and/or otherwise manipulate adjacent cars. In a first example, a first car with higher battery state of charge (SOC) pushes a second car with a lower SOC, imparting a first contact force at the rear end of the second car, wherein the second car pushes a third car with a second contact force which is less than the first contact force. Where contact is limited to compressive contact (e.g., 'pushing' at the front end of cars, without tensile forces between cars, etc.), energy can be substantially transmitted between cars of the platoon in the direction of motion of the platoon (an example is shown in FIG. 7). In a steady state case, energy can be transmitted in the direction of motion even while each car expends energy (e.g., depleting a battery SOC to power an electric powertrain) to maintain the platoon via torque and/or speed control. Accordingly, 'load balancing' may still deplete energy from the car with the lowest remaining (electric) range and/or lowest SOC, but at a slower rate, thus reducing the variance in the SOC distribution among cars of the platoon and increasing the effective range of the platoon. This energy (re)distribution method can be used: at all times (e.g., whenever a car is in a platoon); when the battery state of a leading car (e.g., the lead car, an intermediate car, etc.) falls below a threshold value; based on the relative energy distribution between different cars, when climbing a hill (e.g., when the car is traversing up an incline); and/or at any other time.

In variants, load balancing may be used to offset the effects of drag gradients and/or non-uniformities in drag effects across various cars of the platoon. For example, load balancing can be controlled based on a relative drag gradient within the platoon and/or non-uniformities in the net drag at various cars of the platoon (e.g., particularly a lead car).

In variants, it may be further advantageous to maintain an energy source (e.g., remaining energy in the battery) of a lead car and/or lead vehicle of a lead car to facilitate continuous autonomous protections and/or monitoring at the lead car. For example, the guidance sensors which can enable autonomous operation, such as cameras, Lidar, radar, and/or other sensors, arranged on trailing cars in the platoon may be at least partially obstructed in the direction of motion by the cars ahead of them, and thus may depend on the lead car (and/or a lead vehicle thereof) to detect and/or respond to platoon events (e.g., in accordance with S130). Accordingly, in some variants load balancing can enable the lead car to maintain a continuous energy supply, even without significant power contributions from a powertrain of the lead car (e.g., regeneratively braking while maintaining continuous speed, idle powertrain while being pushed at continuous speed, contributing only a fractional amount of power to maintain speed, etc.). Additionally or alternatively, one or more sensors in the trailing cars can remain unpowered to preserve energy resources. Alternatively, the lead car may otherwise maintain a continuous energy source (e.g., third rail energy supply, backup power source, etc.).

However, the platoon can otherwise be maintained.

Responding to a platoon event S130 functions to coordinate a response to an event, such as a railway hazard, across the platoon. Platoon events can be detected and/or determined by the dispatcher, autonomous agents of one or more cars (e.g., a lead car and/or a lead vehicle of a lead car), external infrastructure (e.g., rail side monitoring equipment, etc.), a human operator (e.g., human onboard a lead car, rail side operator, etc.) and/or can be otherwise suitably determined. In a first variant, the dispatcher can detect a violation of the warrant currently occupied by the platoon—such as a separate car entering the warrant or the platoon deviating from the warrant. In a second variant, external infrastructure can detect a hazard, such as a failed railroad switch. In a third variant, an autonomous agent can detect a hazard—such as a person or automobile proximal to the rail—based on the measurements from the sensor suite of one or more cars of the platoon. In a fourth variant, a platoon event can be determined based on an input received from a human operator (e.g., onboard a car of the platoon or offboard the platoon; brake command, full stop request, reroute request, etc.). In response to determining a platoon event, the platoon can coordinate with one or more responses.

In variants, the platoon can respond to a platoon event with a coordinated acceleration or deceleration of the platoon within a threshold acceleration range (e.g., within a nominal frictional limit of the wheels). In such variants, the lead car (lead vehicle) of the platoon can provide the control input for the remaining cars (e.g., by transmitting acceleration or deceleration control instructions to the remaining cars; by braking and relying on the trailing cars' force feedback loops to follow the lead car acceleration or deceleration; etc.). During coordinated decelerations, the platoon preferably employs regenerative and/or electric braking (e.g., for cars including a pair of electric bogies). Typically braking in this manner can increase the operational efficiency and/or lengthen the service life of car components (e.g., before frictional brakes need to be serviced or replaced). In instances where the platoon must decelerate rapidly (e.g., within the line of sight of the lead car/sensors), the platoon can additionally or alternatively employ frictional braking in order to rapidly slow the car. In such instances, each car can individually receive a wireless signal associated with a full-stop braking event, which may be broadcast by the dispatcher and/or a car of the platoon (e.g., such as the lead car; such as the car initiating the platoon event). In a first example, each car (and/or each vehicle thereof) of the platoon independently supplies maximum braking (e.g., as regulated by independent onboard ABS systems; based on the static friction of the wheels). In this example, rear cars may be controlled to brake more quickly, which may separate one or more cars/sections of the platoon from continuous contact (e.g., dropping cars from the rear of the platoon, such as from back to front; according to S140, wherein individual dropped cars can traverse independently S112 or otherwise operate). Alternatively, the platoon can coordinate to preserve contacts between adjacent cars during full-stop (e.g., emergency) brake events.

As an example, in a first car of the platoon can autonomously detect an obstacle and decelerate in response. This deceleration can mechanically instruct a coordinated, independent braking of each independently-maneuverable rail car within the platoon (e.g., based on the bumper contact forces, etc.).

In variants, the platoon can respond to a powertrain failure event of one or more cars of the platoon. In such instances, the cars trailing the car with the powertrain failure can provide propulsion by pushing the rear of the car (e.g., rear end contact force exceeds front end contact force) to compensate for the diminished propulsive capability. If a rear car experiences a powertrain failure, it may be separated from the platoon according to S140.

In variants, the platoon can respond to sensor/autonomy failures of one or more trailing cars by escorting the car experiencing the failure with a lead car(s) according to S120, and/or communicating control instructions wirelessly (e.g., in the event of load cell failure at the front end of a car). If the lead car of a platoon relative to the direction of traversal experiences a failure, the platoon may be escorted by joining an additional car to the front end of the platoon (according to S110), and relying on the additional cars to escort the platoon. Additionally or alternatively, the platoon can be reversed (e.g., rearmost car/vehicle operates as lead car/vehicle), and/or otherwise suitably controlled.

However, the platoon can otherwise suitably respond to platoon events.

Figure 4D:
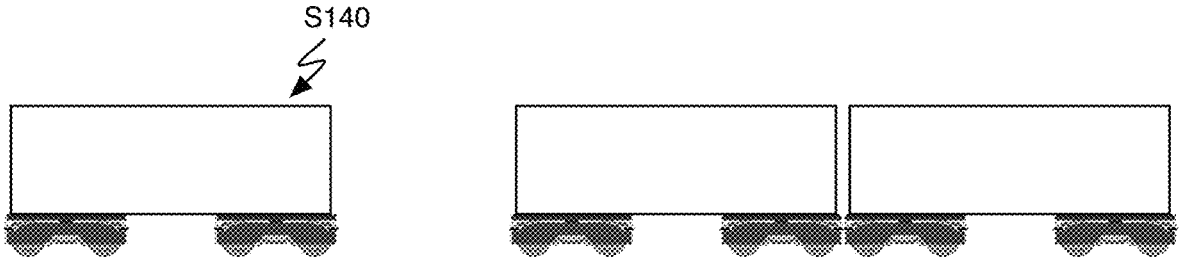

Separating a platoon S140, an example of which is shown in FIG. 4D, functions to separate one or more cars of the platoon. Cars can be separated while the platoon is stationary, during traversal, and/or in response to a platoon event (e.g., powertrain failure of rearmost car, dropping trailing cars during coordinated braking, etc.). Cars can be separated manually, automatically, in response to commands by the dispatcher, based on a destination of sets of cars of the platoon, based on an arrangement of cars relative to infrastructure (e.g., roads, intersections, terminal infrastructure, etc.), based on a state of charge (SOC) of one or more cars of the platoon, based on a failure state of one or more cars of the platoon, and/or can be otherwise suitably separated. Cars can be separated in the direction of traversal (e.g., front acceleration, rear deceleration, etc.), opposite the direction of traversal, while a subset of cars is stationary, and/or in any other suitable manner.

In a first variant, a set of one or more cars can be separated by (cooperatively) decelerating the set of cars until they depart the warrant of the platoon and/or exceed a threshold distance from the platoon (e.g., the threshold distance as governed by S112, a different threshold distance, etc.). In a specific example, the separating set of cars can be controlled to decelerate at (or beyond) the maximum coordinated braking threshold as specified in S120, such that any coordinated decelerations of the platoon will not result in an impact with the separating cars. However, full-stop/emergency braking events can be broadcasted to and/or coordinated with the separating set of cars.

In a second variant, at a temporary stop of a platoon traversing in a first direction, a rear set of cars of the platoon can be separated by reversing the set (e.g., in a second direction opposing the first direction). As an example, a platoon can separate at a crossroad to avoid directly blocking traffic on the road, such as by reversing car(s) blocking the road (and the cars trailing them relative to the first direction). Additionally or alternatively, platoons can separate at crossroads by advancing cars at the leading end of the platoon (e.g., in the first direction; an example is shown in FIGS. 11A-F) or can be otherwise suitably configured.

In a third variant, the platoon can be split prior to directing distinct sets of cars along diverging sets of tracks—such as in advance of a railway switch.

Figure 9A:
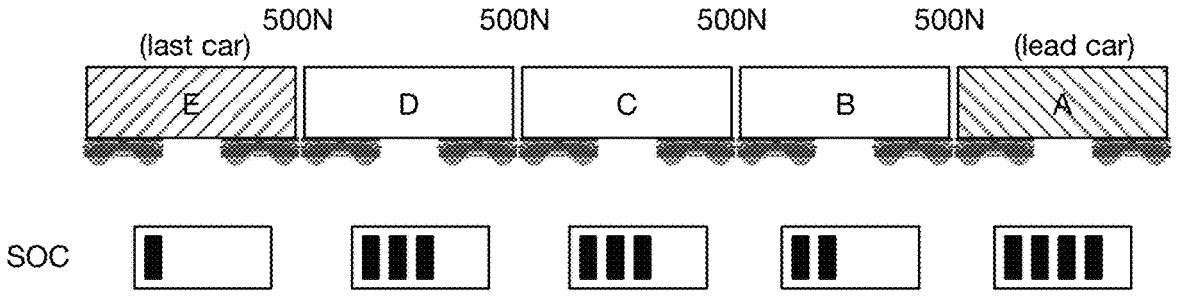
FIGS. 9A-C are a first, second, and third diagrammatic representation of the system, respectively.
Figure 9B:
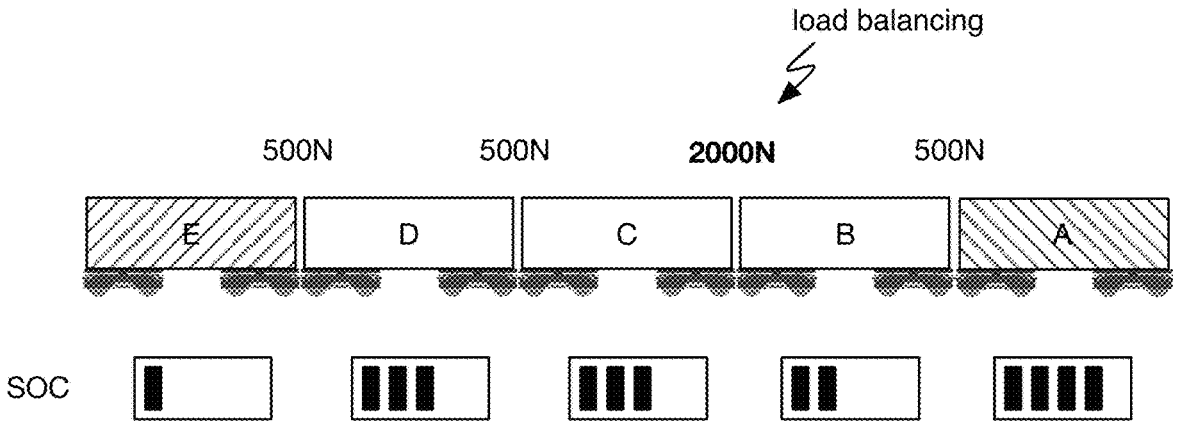
Figure 9C:
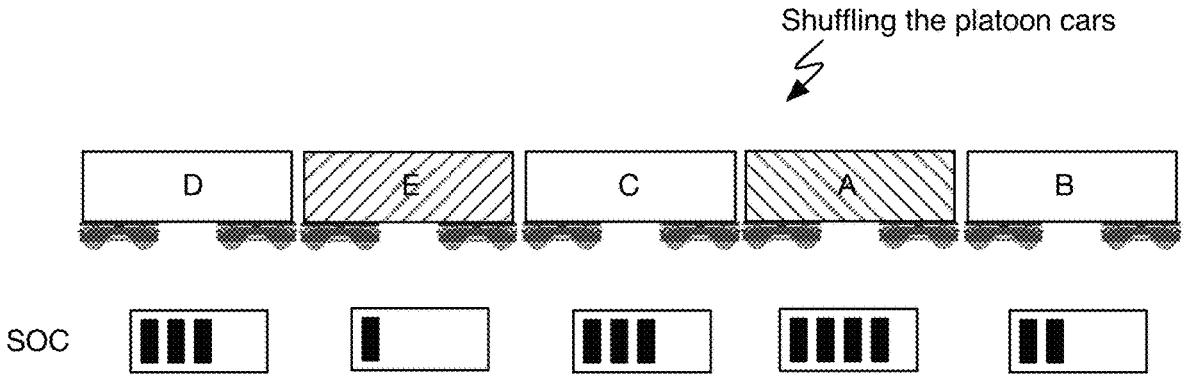

In a fourth variant, cars of the platoon can be rearranged/shuffled by utilizing sections of passing track. This can be particularly advantageous to redistribute energy rearward along the platoon. In particular, since the rear car of the platoon relative to the direction of traversal may experience larger aerodynamic losses than other cars of the platoon (e.g., as a result of pressure drag at the rear) and maintains unbalanced contact forces (e.g., providing a push without receiving a push; pushing harder than being pushed; compressive force applied at a trailing bumper is different from compressive force at leading bumper of the car), it may be the range limiting car of the platoon (e.g., for equal initial SOC and payloads). Accordingly, rearranging cars of the platoon by separating the platoon, advancing/retreating the separated car(s) relative to the remaining cars of the platoon, and repeating Silo, the cars can effectively be shuffled and/or rearranged (e.g., provided the sequence of cars of the separated set and remaining set of cars of the platoon are preserved). Accordingly, cars can be rearranged based on the state of charge, powertrain state, and/or sensor state of the platoon (an example is shown in FIG. 9C). In a specific example, a first (e.g., rear) car and second car (e.g., adjacent to the rear car) of a platoon traversing in a first direction can be separated from the platoon; the second car can be routed along a passing track until the first car advances past a converging switch; the second car and first car can then be rejoined with the platoon, with the second car trailing (pushing) the first car.

However, the platoon can be otherwise suitably separated.

5. Examples

In an example, a platoon can coordinate braking through indirect means such as controls or external sensors (unlike traditional trains whose coordinated braking is assured through a common air brake line which spans the entire assembly). Successful coordination of braking activities may be critical in some circumstances to avoid derailment or cascading failures within a platoon. The importance of this braking sequence depends on the performance margin which remains in the assembly in case of severe braking events. The subtlety and importance of these braking decisions at high speeds may be much greater than what is what's allowed at slower speeds. An example process flow for braking can include: determining a brake command (e.g., internally or externally), which is relayed back to the platoon. The resulting echo of commands may be used to verify the safety of performing the braking command within the platoon, as well as verifying the size and source of the braking event which has been initiated. As braking is coordinated and initiated, accelerometers and external force sensors can be monitored within the platoon to detect off-nominal loads which may indicate faults. In the case of faults, differences in acceleration and loads within a platoon may be used to determine the location, nature, and severity of the fault. This feedback may be used to determine the correct response which may include release of braking force or application of additional force via mechanical brakes. Once the change in speed has been achieved and a braking release command is generated, this is again relayed to the platoon. The resulting echo of commands may be used to verify the safety of releasing brakes within the platoon. However, the braking can be otherwise coordinated.

In variants, creating a platoon can include loading and/or joining pairs of rail drones, such as those described in U.S. application Ser. No. 17/335,732, filed 1 Jun. 2021, and/or in U.S. application Ser. No. 17/694,499, filed 14 Mar. 2022, both of which are incorporated herein in their entirety by this reference. Unlike traditional trains whose cars are physically attached and subsequently brought to a location for loading, these rail cars are formed from loose (physically decoupled) rail drones which may need to be acquired and arranged for each payload. Thus, the loading process can rely on a sequence of steps which pairs arbitrary drones with specific demand, co-locates them, and then safely joins them.

An example process flow for creating a car can include: starting with a payload loading request (e.g., from a dispatcher, each associated with a warrant), rail drones are assigned to the request. Assignment of a specific rail drone may be based on factors like proximity, state of charge, line of sight, time for relocation, or number of moves (for example spur switches) for relocation. Following assignment, rail drones can self-relocate to a loading area under their own power (e.g., operating individually under a warrant, autonomously operated, remotely controlled by a dispatcher, etc.). This relocation process may occur in a configuration which doesn't match that of the final payload, for example being tightly paired until arrival at the loading zone to reduce track length footprint during internal transit. Upon arrival at the loading zone, the rail drones can position themselves for their intended payload including their relative position for the payload and absolute position for a loader. Once in place, during the loading process, the rail drones may perform additional position corrections based on feedback from the payload geometry and position. This can be via coordination with the operator and/or via internal feedback via onboard sensors like cameras. Once the payload has been installed, onboard fittings can be engaged to fully restrain the payload. Within, before, or after this step additional verifications on weight, weight distribution, and fitting engagement may be performed to confirm that the payload can be safely moved. However, cars can otherwise be formed as a part of platoon creation, and/or platoon creation may occur independently of car formation (e.g., fully asynchronously with car formation, during transit, etc.).

However, platoons and/or cars can be otherwise formed.

In variants, aerodynamic efficiency of the during platooning can be provided via a physical configuration of the rail drones and/or the cars formed therewith (e.g., unlike trucks and trains which may use specialized aerodynamic fittings or carefully arranged payloads to improve aerodynamic efficiency, high-efficiency performance of the platoon can be achieved with no structural modification for aerodynamics). As an example, the arranging payloads near the leading and trailing edges of the car and/or establishing (continuous) contact between the bumpers of platooning cars may minimize the air gap between platooning cars (and payloads). This approach may largely obsolete the process of organizing the sequence of train payloads to improve efficiency. However, the technology can otherwise minimize an air gap and/or improve aerodynamic efficiency.

Alternative embodiments implement the above methods and/or processing modules in non-transitory computer-readable media, storing computer-readable instructions. The instructions can be executed by computer-executable components integrated with the computer-readable medium and/or processing system. The computer-readable medium may include any suitable computer readable media such as RAMs, ROMs, flash memory, EEPROMs, optical devices (CD or DVD), hard drives, floppy drives, non-transitory computer readable media, or any suitable device. The computer-executable component can include a computing system and/or processing system (e.g., including one or more collocated or distributed, remote or local processors) connected to the non-transitory computer-readable medium, such as CPUs, GPUs, TPUS, microprocessors, or ASICs, but the instructions can alternatively or additionally be executed by any suitable dedicated hardware device.

Embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

As a person skilled in the art will recognize from the previous detailed description and from the figures and claims, modifications and changes can be made to the preferred embodiments of the invention without departing from the scope of this invention defined in the following claims.

We claim:

1. A method for coordinated braking within a rail platoon, comprising:

determining, at an autonomous rail vehicle within the rail platoon, a compressive force at a leading end of the autonomous rail vehicle in a direction of traversal;

determining a coordinated braking event; and in response to determining the coordinated braking event, braking at the autonomous rail vehicle while maintaining compression at the leading end, comprising autonomously controlling an independent set of brakes of the autonomous vehicle based on the compressive force at the leading end.

2. The method of claim 1, wherein braking at the autonomous rail vehicle comprises: based on the compressive force, independently controlling a regenerative braking of a battery-electric powertrain of the autonomous vehicle.

3. The method of claim 1, wherein the leading end comprises an abutment surface of a bumper which is suspended relative to a chassis of the autonomous rail vehicle.

4. The method of claim 1, wherein determining the coordinated braking event comprises receiving a braking command via a vehicle-to-vehicle (V2V) communication from a rail vehicle within the rail platoon.

5. The method of claim 4, further comprising: in response to receiving the V2V communication, relaying the braking command to a second autonomous rail vehicle within the platoon.

6. The method of claim 1, wherein the coordinated braking event is determined based on the compressive force.

7. The method of claim 1, further comprising: separating from the platoon based on a track geometry or a location of a level crossing.

8. The method of claim 1, wherein the compressive force is determined with a load cell.

9. A method, comprising:

determining, at a rail vehicle within a rail platoon, a contact force at a leading end of the rail vehicle in a direction of traversal; and autonomously controlling the rail vehicle within the rail platoon, comprising:

determining a platoon control target; and based on the contact force, controlling an independent powertrain of the rail vehicle to achieve the platoon control target.

10. The method of claim 9, wherein the independent powertrain comprises a battery-electric powertrain.

11. The method of claim 10, wherein autonomously controlling the rail vehicle comprises regeneratively braking with the battery-electric powertrain.

12. The method of claim 9, wherein the leading end comprises an abutment surface of a bumper which is damped relative to a chassis of the autonomous rail vehicle.

13. The method of claim 9, wherein the platoon control target comprises a target contact force.

14. The method of claim 13, wherein the target contact force is based on a relative energy distribution of the rail platoon.

15. The method of claim 9, wherein the platoon control target comprises a speed setpoint.

16. The method of claim 9, further comprising:

receiving, at the autonomous rail vehicle, a set of dispatch instructions associated with a coordinated separation of the rail platoon; and based on the set of dispatch instructions, controlling the independent powertrain of the rail vehicle to separate from a leading portion of the rail platoon at the leading end.

17. The method of claim 16, wherein the coordinated separation is based on a track geometry or a location of a level crossing.

18. The method of claim 16, wherein the set of dispatch instructions comprises a warrant for the autonomous rail vehicle, wherein the control target is determined based on the warrant.

19. The method of claim 9, wherein autonomously controlling the rail vehicle within the rail platoon comprises: at the leading end of the rail vehicle, pushing an adjacent rail vehicle.

20. The method of claim 19, wherein no components span between the rail vehicle and the adjacent rail vehicle.

* * * * *